US009480338B2

(12) United States Patent
Griggs, Jr.

(10) Patent No.: US 9,480,338 B2
(45) **Date of Patent: *Nov. 1, 2016**

(54) READY TO ASSEMBLE SOFA AND METHOD FOR PACKAGING SAME

(71) Applicant: Billy Joe Griggs, Jr., Pulaski, TN (US)

(72) Inventor: Billy Joe Griggs, Jr., Pulaski, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/846,535

(22) Filed: Mar. 18, 2013

(65) Prior Publication Data

US 2014/0001812 A1 Jan. 2, 2014

Related U.S. Application Data

(63) Continuation-in-part of application No. 13/423,701, filed on Mar. 19, 2012, now Pat. No. 8,480,179, and a continuation-in-part of application No. 13/293,429, filed on Nov. 10, 2011, now Pat. No. 8,408,653, and a continuation-in-part of application No. 13/045,240, filed on Mar. 10, 2011, now abandoned, and a continuation of application No. 12/824,469, filed on Jun. 28, 2010, now abandoned, and a continuation of application No. 11/580,482, filed on Oct. 13, 2006, now Pat. No. 7,744,162.

(60) Provisional application No. 60/726,304, filed on Oct. 13, 2005.

(51) Int. Cl.
*A47C 4/02* (2006.01)
*A47C 17/00* (2006.01)

(52) U.S. Cl.
CPC ..... *A47C 4/028* (2013.01); *A47C 17/00* (2013.01)

(58) Field of Classification Search
USPC ..... 297/440.1, 440.13, 440.14, 440.15, 297/440.16, 232
See application file for complete search history.

(56) References Cited

U.S. PATENT DOCUMENTS 5,890,767 A * 4/1999 Chang ..... 297/440.14
7,963,612 B2 * 6/2011 Nelson ..... 297/440.1
8,408,653 B2 * 4/2013 Griggs, Jr. ..... 297/440.14

* cited by examiner

*Primary Examiner* — Sarah McPartlin
(74) *Attorney, Agent, or Firm* — W. Edward Ramage

(57) ABSTRACT

A furniture system having a base frame, side pieces and a back portion, that assembles quickly and disassembles into a configuration that optimizes space when shipped.

8 Claims, 42 Drawing Sheets

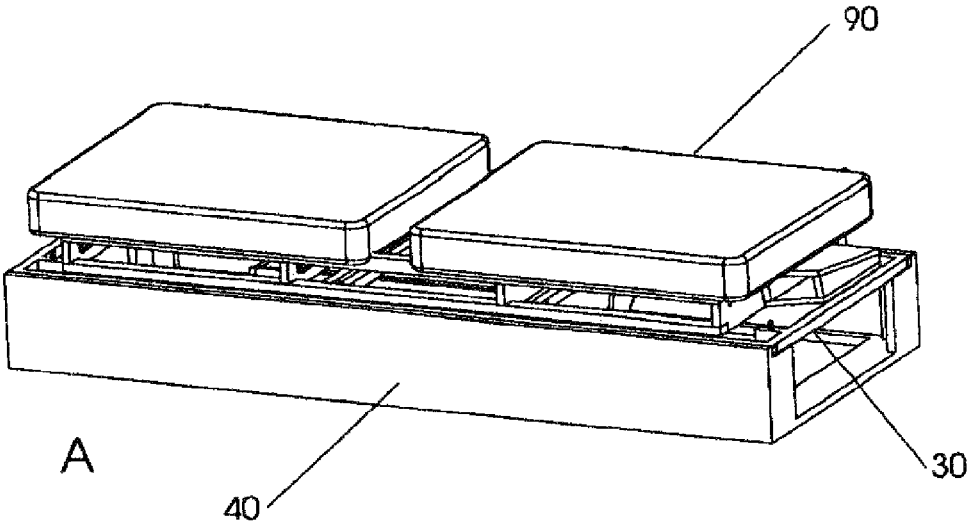
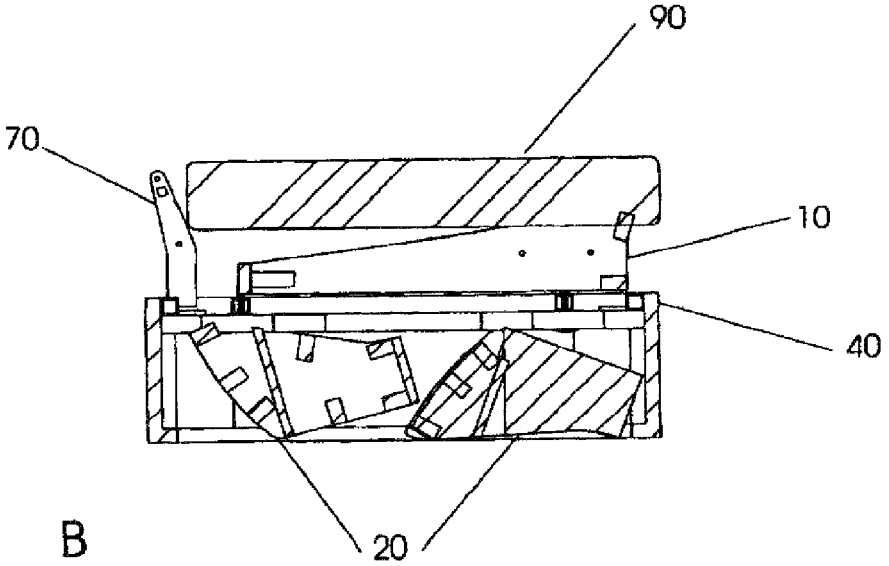
Fig. 2

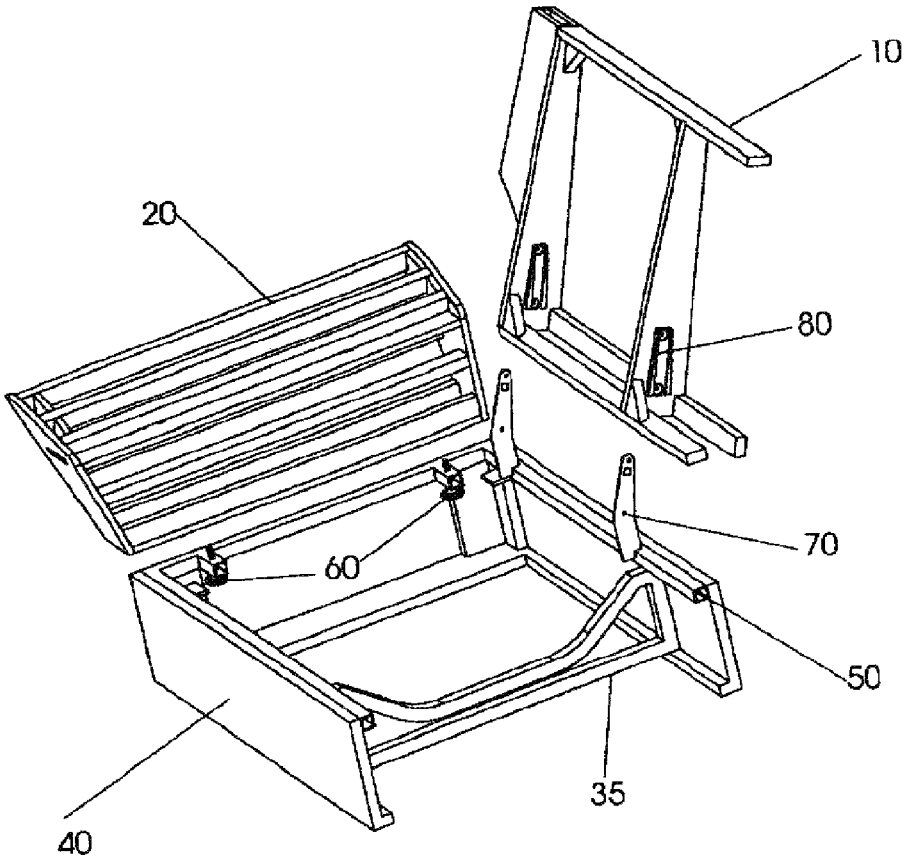
A
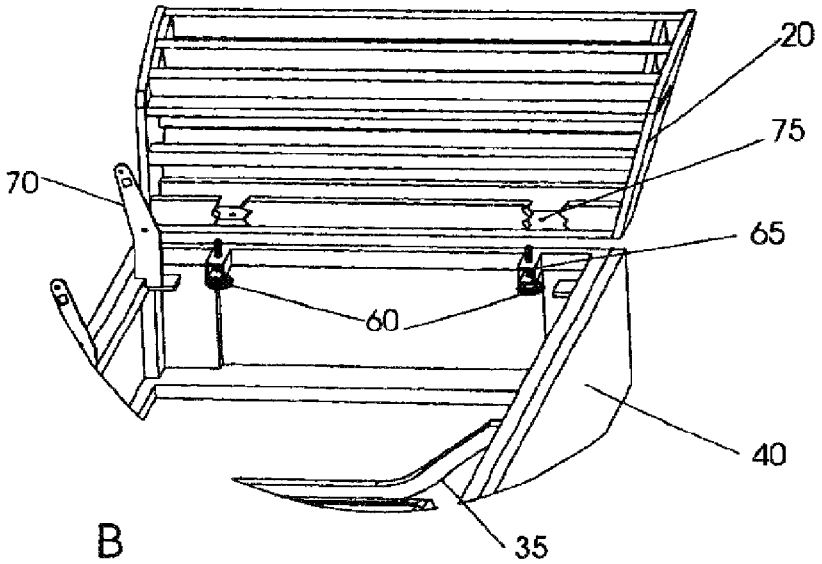
B
Fig. 4

READY TO ASSEMBLE SOFA AND METHOD FOR PACKAGING SAME

INDEX TO RELATED APPLICATIONS

This application is a continuation of U.S. patent application Ser. No. 13/423,701 filed Mar. 19, 2012, now U.S. Pat. No. 8,480,179, issued Jul. 9, 2013, which is a continuation-in-part of U.S. patent application Ser. No. 13/293,429 filed Nov. 10, 2011, now U.S. Pat. No. 8,408,653, issued Apr. 2, 2013, which is a continuation in part of U.S. patent application Ser. No. 13/045,240 filed Mar. 10, 2011, abandoned Dec. 1, 2011, which is continuation-in-part of U.S. patent application Ser. No. 12/824,469 filed Jun. 28, 2010, abandoned Apr. 5, 2011, which is a continuation of U.S. patent application Ser. No. 11/580,482, filed Oct. 13, 2006, now U.S. Pat. No. 7,744,162, issued Jun. 29, 2010, which claims benefit of U.S. provisional patent application Ser. No. 60/726,324 filed Oct. 13, 2005 the disclosures of which are incorporated herein by reference in their entirety.

BACKGROUND OF THE INVENTION

The present invention relates generally to ready-to-assemble ("RTA") furniture. More specifically, the present invention relates to RTA sofas, RTA love seats, RTA chairs and similar articles of RTA furniture that are configured for rapid assembly from a partially assembled state to a fully assembled state after shipping and storage stages.

BRIEF SUMMARY OF THE INVENTION

This present invention, an article of RTA furniture, although a sofa is generally described, the present invention is suitable in RTA chairs, love seats, sofas, etc. and includes a base assembly, a back assembly and left and right arm assemblies that are constructed and arranged for minimizing packaging volume in a partially assembled state and for rapid assembly from said partially assembled state to a fully assembled state with minimal effort and tools.

In one embodiment, the invention comprises an upholstered furniture system comprising:

a first assembled configuration for seating;

a second unassembled configuration for storage and shipping, comprising:

a horizontal seat support frame having front and rear support frame members; wherein said rear support member comprises at least two male fasteners for receiving complementary female fasteners from a seat back frame;

left and right side support frame members, wherein said left and right side support frame members each comprise at least 2 orifices for receiving two male fasteners for interacting with complementary female fasteners from a respective arm member;

a back member, having male fasteners for assembling with complementary female fasteners secured to said horizontal seat support frame;

left and right arm members, each of said left and right arm members having a female fastener for receiving male fasteners attached to said horizontal seat support frame; and wherein said horizontal seat support frame comprises a cavity to contain, in said unassembled configuration, each of said arm members to be used with said furniture system.

The cavity may, in one embodiment, further contain cushions used in said assembled configuration.

In the furniture system of the present invention, said unassembled configuration is substantially rectangular. Previous to construct a furniture system as per the present invention were unsuccessful because those attempts did not account for storage of arm portions. The present invention provides that in said unassembled state, arm portions nest within a cavity formed within the border of said horizontal seat support frame.

Said arm portions may interconnect in a dissembled state such that they nest within the boundary of said cavity in said horizontal seat support frame.

Said back member is constructed and arranged to connect to said horizontal seat support frame by a male-female connection.

In the furniture system each of said left and right arm members attach to said horizontal seat support frame by interacting with male connection of placed through said frame with orifices on each of said left and right arm members and said left and right arm members are secured with hand tightening nuts, such as wing nuts. This assembly system provides a process that allows assembly without the use of tools.

Also contemplated is a method of shipping Ready to Assemble (RTA) furniture, comprising the steps of:

a) providing RTA components of furniture comprising:

a horizontal seat support frame;

left and right side pieces;

a back frame;

cushions;

b) assembling said RTA components such that they form a rectangular configuration, wherein said rectangular configuration provides said left and right side portions constructed and arranged to nest within the underside of said horizontal seat support frame, and said back portion nests on top of said frame; and packaging said RTA furniture into a conventional shipping container such that each unit forming said rectangular frame efficiently utilizes the available shipping space within a conventional shipping container.

In another embodiment the present invention is an upholstered furniture system consisting of:

a first assembled configuration for seating;

a second unassembled configuration for storage and shipping, comprising:

a horizontal seat support seat support frame having front and rear support frame members; wherein said rear support member comprises at least two male fasteners for receiving complementary female fasteners from a seat back frame;

left and right side support frame members, wherein left and right side support frame members each comprise a pair of male fasteners for receiving complementary female fasteners from a respective arm member;

a back member, having male fasteners for assembling with complementary female fasteners secured to said horizontal seat support frame;

left and right arm members, each of said left and right arm members having an female fastener for receiving male fasteners attached to said horizontal seat support frame; and wherein said horizontal seat support frame comprises a cavity to contain each of said arm members and cushions to be used with said furniture system.

The cavity may, in one embodiment, further contain cushions used in said assembled configuration. In the furniture system of the present invention, said unassembled configuration is substantially rectangular. Previous attempts at providing RTA furniture and systems to maximize shipping space did not account for storage of arm portions.

The present invention provides that in said unassembled state, arm portions nest within a cavity formed within the border of said horizontal seat support frame. Said arm portions may interconnect in a dissembled state such that they nest within the boundary of said cavity in said horizontal seat support frame.

Said back member is constructed and arranged to connect to said horizontal seat support frame by a male-female connection.

In the furniture system each of said left and right arm members attach to said horizontal seat support frame by interacting with a male connection placed through said frame with orifices on each of said left and right arm members and said left and right arm members are secured with wing nuts, or hand tightening nuts. Thus assembly is without the use of tools.

The base assembly includes a base frame having a storage cavity for receiving the left and right arm assemblies for storage during shipment and storage of the article of furniture. Use of movable supports transversing the storage cavity facilitates storage of the arm assemblies when the supports are moved out of the way and provides needed strength and rigidity when the supports are moved into a support position during final assembly of the article of RTA furniture. This novel feature of storing the arms in the base cavity allows for a significant reduction of shipping volume per unit of furniture, which in turn greatly reduces shipping and handling costs. Conventionally, the RTA arms would be shipped in a shipping box separate from the box housing the base and back assemblies. In addition to the saving in reduction of volume, handling costs and inventory losses are reduced because shipping is consolidated to a single shipping box.

In one preferred embodiment, the base frame is a box frame having a base front frame portion, a base rear frame portion, and right frame portion and left frame portion. Upon final assembly, one or more movable support members transverse the storage cavity to provide structural support of the base assembly during use of the article of furniture. In one preferred embodiment, the moveable support members comprise swing gates. The base frame also includes right and left base extensions for receiving the left and right arm assemblies for rapid assembly of the RTA article of furniture. The frame extensions each include a lower arm mounting assembly upon which an upper arm mounting assembly of the respective arm assembly is received. Fast operating fastener components pre-mounted upon the upper and lower arm mounting assemblies allow for rapid attachment of the arm to the base frame extension. In one preferred embodiment, wing-nut fastener assemblies are used. In another preferred embodiment snap-in fasteners are used.

The base assembly also includes base cushions and a cushion support, such as interwoven webbing or box springs. The base assembly further includes upholstery covering portions of the base frame. One advantage of this assembly is that the right and left base extensions are not upholstered while the front, the outside, the top and the inside portions of the arm assemblies are fully upholstered. This provides a small vertical crevasse between the upholstered arm and the upholstered front of the base assembly. This is characteristic of conventionally manufactured furniture. The arm fronts of prior art RTA furniture have only the upper portion upholstered while the front face of the base assembly is fully upholstered. This creates an elongated horizontal crevasse along the front of each arm.

The base assembly further has a quick connecting bracket either receiving or being received by the opposite gendered bracket of the back assembly. The base cushions and the back cushions (if detachable) are vacuum packed and stacked between the base assembly (with the arms placed in the storage cavity) and the back assembly in a minimal volume configuration. The RTA article is optionally compressed further and placed in a storage container such as a shipping box.

It is another object of the present invention to provide a ready to assemble furniture system that assembles without the use of tools.

In one embodiment the present invention is

An upholstered furniture system comprising: (a) a first assembled configuration for seating; (b) a second unassembled configuration for storage and shipping, said upholstered furniture system comprising: (i) a horizontal seat support frame, said frame having opposing front and rear panels and opposing side panels, said panels arranged fixedly and continuously to define a rectangular storage cavity, said frame further comprising a fixed support members extending generally perpendicularly between said front and rear panels and within said cavity, said support members has opposing vertical sides that are parallel and adjacent to an inner surface of each of said front and rear panels and is positioned within said cavity and extend in a perpendicular orientation between each of said front and rear panels, said support member defines a portion of said cavity into at least two subcavities, wherein each subcavity receives arm members and cushions configured to nest in said sub cavity in said unassembled configuration; (ii) a back frame member; (iii) left and right arm members; (iv) wherein said rear support panel connects with said back frame through male-female fasteners; (v) wherein said left and right side support frame panels connect to respective arm member utilizing male-female connectors; and wherein in said second unassembled configuration said arm members and a plurality of cushions to be used in said system are positioned in said cavity each in a subcavity.

And further the present invention, in one embodiment is a method of shipping Ready to Assemble (RTA) furniture comprising the steps of: (a) providing RTA components of furniture comprising: i) a horizontal seat support frame, said frame having opposing front and rear panels and opposing left and right side panels, said panels arranged fixedly and continuously to define a rectangular storage cavity, said frame further comprising a fixed support members extending generally perpendicularly between said front and rear panels and within said cavity, said support members has opposing vertical sides that are parallel and adjacent to an inner surface of each of said front and rear panels and is positioned within said cavity and extend in a perpendicular orientation between each of said front and rear panels, said support member defines a portion of said cavity into at least two subcavities, wherein each subcavity receives arm members and cushions configured to nest in said sub cavity in said unassembled configuration; (ii) a back frame member; (iii) left and right arm members; (iv) wherein said rear support panel connects with said back frame through male-female fasteners; (v) wherein said left and right side support frame panels connect to respective arm member utilizing male-female connectors; and wherein in said second unassembled configuration said arm members and a plurality of cushions to be used in said system are positioned in said cavity each in a subcavity; (b) assembling said RTA components such that they form a rectangular configuration, wherein said rectangular configuration provides said left and right arm members; nest within the rectangular storage cavity of said horizontal seat support frame when said movable support members are moved in a swivel motion about a said pin, to a horizontal orientation relative to said frame, to facilitate storage of said RTA components in said horizontal seat support frame, and said back portion nests on top of said frame; (c) packaging the rectangular configuration of the RTA components into a conventional shipping container and substantially maximizing utilization of available shipping space within said conventional shipping container.

In another embodiment, the present invention is an upholstered furniture system comprising: (a) a first assembled configuration for seating; (b) a second unassembled configuration for storage and shipping, said upholstered furniture system comprising: (i) a horizontal seat support frame, said frame having opposing front and rear panels and opposing side panels, said panels arranged fixedly and continuously to define a rectangular storage cavity, said frame further comprising a movable support member extending generally perpendicularly between said front and rear panels and within said cavity, said support is positioned within said cavity and extend in a perpendicular orientation between each of said front and rear panels, said support member swivels on a pivot incorporated with each horizontal portion of said frame, said support member defines a portion of said cavity into at least two subcavities, wherein each subcavity receives arm members and cushions configured to nest in said sub cavity in said unassembled configuration; (ii) a back frame member; (iii) left and right arm members; (iv) wherein said rear support panel connects with said back frame through male-female fasteners; (v) wherein said left and right side support frame panels connect to respective arm member utilizing male-female connectors; and wherein in said second unassembled configuration said arm members and a plurality of cushions to be used in said system are positioned in said cavity each in a subcavity.

The horizontal frame is substantially rectangular.

The rectangular configuration is defined by horizontal planes corresponding to upper and lower sides of said horizontal seat support frame when said frame is resting on a surface in an environment of use.

Arm portions interconnect in a dissembled state such that said arm portions nest within the boundary of a single subcavity in said horizontal seat support frame.

The horizontal support frame supports a back longitudinal frame member having a vertical angular offset.

Each arm member is constructed and arranged providing each arm member, in said assembled configuration, has a base portion that affixes to the uppermost portion of said support frame. There may be an extending portion along the front of the furniture in the assembled configuration, but the connecting of the arms is the planer base connecting to the top of the support frame.

That is to say, each arm member has a base portion that generally forms a horizontal plane, wherein said horizontal plane is positioned directly upon an upper surface of said support frame when said frame is on a generally flat surface for use.

Each arm member, in said unassembled configuration, is provided with padding, upholstery, and unobstructed access to said male-female connectors for assembly to said assembled configuration.

The present invention is also a method of shipping Ready to Assemble (RTA) furniture comprising the steps of: (a) providing RTA components of furniture comprising: i) a horizontal seat support frame, said frame having opposing front and rear panels and opposing side panels, said panels arranged fixedly and continuously to define a rectangular storage cavity, said frame further comprising a movable support member extending generally perpendicularly between said front and rear panels and within said cavity, said support is positioned within said cavity and extend in a perpendicular orientation between each of said front and rear panels, said support member swivels on a pivot incorporated with each horizontal portion of said frame, said support member defines a portion of said cavity into at least two subcavities, wherein each subcavity receives arm members and cushions configured to nest in said sub cavity in said unassembled configuration; (ii) a back frame member; (iii) left and right arm members; (iv) wherein said rear support panel connects with said back frame through male-female fasteners; (v) wherein said left and right side support frame panels connect to respective arm member utilizing male-female connectors; and wherein in said second unassembled configuration said arm members and a plurality of cushions to be used in said system are positioned in said cavity each in a subcavity; (b) assembling said RTA components such that they form a rectangular configuration, wherein said rectangular configuration provides said left and right arm members; nest within the rectangular storage cavity of said horizontal seat support frame when said arm members nest within a subcavity bounded by said fixed support member, to facilitate storage of said RTA components in said horizontal seat support frame, and said back portion nests on top of said frame; (c) packaging the rectangular configuration of the RTA components into a conventional shipping container and substantially maximizing utilization of available shipping space within said conventional shipping container.

Preferably, the cushions are vacuum packaged to reduce volume of space needed for storage and shipping.

The present invention is also an upholstered furniture system comprising: (a) a first assembled configuration for seating; (b) a second unassembled configuration for storage and shipping, said upholstered furniture system comprising: (i) two horizontal seat support frames, said frames having opposing front and rear panels and opposing side panels, said panels arranged fixedly and continuously to define a rectangular storage cavity, said frames each defining a storage cavity, wherein each cavity receives arm members and cushions configured to nest in said cavity in said unassembled configuration; (ii) a back frame member for each frame; (iii) at least one arm member; (iv) wherein said rear support panel connects with said back frame through male-female fasteners; (v) wherein said left and right side support frame panels connect to respective arm member utilizing male-female connectors; and wherein in said second unassembled configuration said arm members and a plurality of cushions to be used in said system are positioned in said cavity each in a cavity.

Each horizontal support frame is constructed and arranged to detachably connect to the other in an assembled configuration to form a single article of furniture.

The detachable connection is through male-female connectors.

In a configuration utilizing two or more frames, the horizontal frames may be either detachably connected one to another, or each frame, in an assembled configuration, is an independent article of furniture.

BRIEF DESCRIPTION OF THE DRAWINGS

FIG. 2 shows perspective (A) and side views (B) of one embodiment of the sofa packaged for shipping.

FIG. 4 shows close up views (A) and (B) depicting the attachment of the back and side portions to the frame.

FIG. 15A is an expanded view of arm extension in the embodiment of FIG. 42.

FIG. 16A is an expanded view of arm extension in the embodiment of FIG. 42.

FIG. 17A is an expanded view of a corner of the frame in the embodiment of FIG. 42.

FIG. 18A is an expanded view of back portion placement in the embodiment of FIG. 42.

FIG. 43 is a detail from FIG. 45 showing assembled configuration of two back portions into a single article of furniture.

FIG. 45 is view of the components of the sofa of the present invention in which 2 frame portions are packaged in an unassembled configuration with arm portions there between.

DETAILED DESCRIPTION OF THE INVENTION

Figure 1:
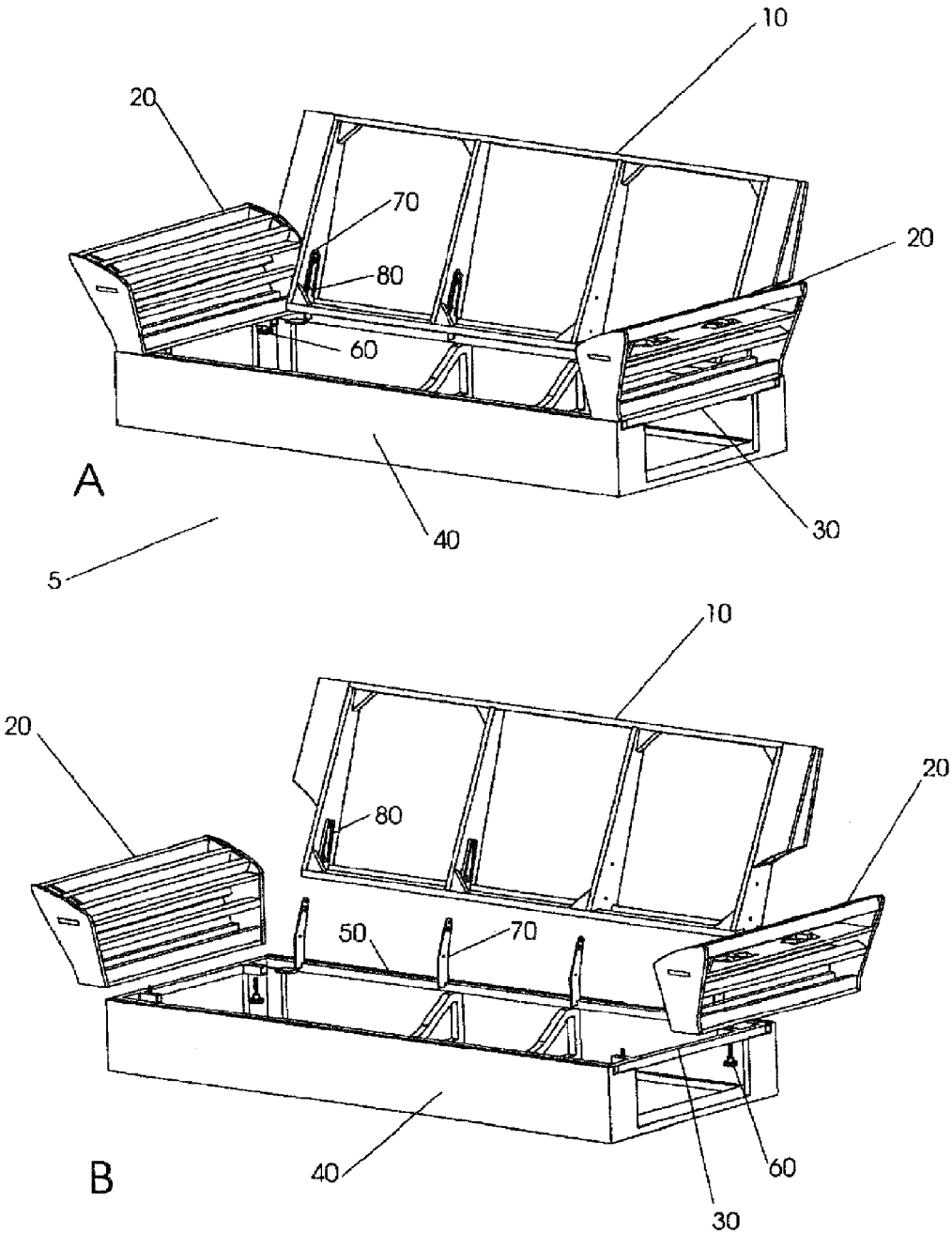
FIG. 1 shows a perspective view of the assembled (A) and unassembled (B) configurations.

Referring now to FIG. 1A, is one embodiment of the fully assembled RTA frame 5 and is shown including the base assembly frame 40 and the left and right arm frames 20 connected to each side portion 30 with a screw 60, and the back frame 10 joined to rear portion of frame 50 by male connector 70 and female connector 80 in an assembled configuration. This RTA frame is typically obscured by padding and upholstery when the RTA furniture is manufactured. FIG. 1B shows a perspective view with each of the aforementioned elements separated from their attached configuration.

Referring now to FIG. 2A shows a perspective view of the unassembled system. The front of the frame 40 side portion of frame 30, and, in the shown embodiment, cushions 90 are shown placed on top of frame 40 for storage to substantially form a rectangular configuration. Said rectangular configuration is defined as a horizontal planes corresponding to each side of said horizontal seat support frame. That is to say, component pieces do not extend outward past the sidepieces of the horizontal seat support frame. The component pieces also do not extend outward past each of the front and back potions of the horizontal seat support frame. Previous attempts at RTA furniture for storage were deficient in that the arm portions extended outward from the frame when stored. The extensions of the arm portions from the rectangular configuration in which the configuration is defined by the shape of the base alone has made shipping such systems less efficient than those systems manufactured according to the current invention. Also shown is FIG. 2B, a side view whereby arm portions 20 are placed in a nesting arrangement in a cavity inside frame 40. Back portion 10 is placed on top of frame 40 and cushions 90 are on top of back portion 10.

Figure 3:
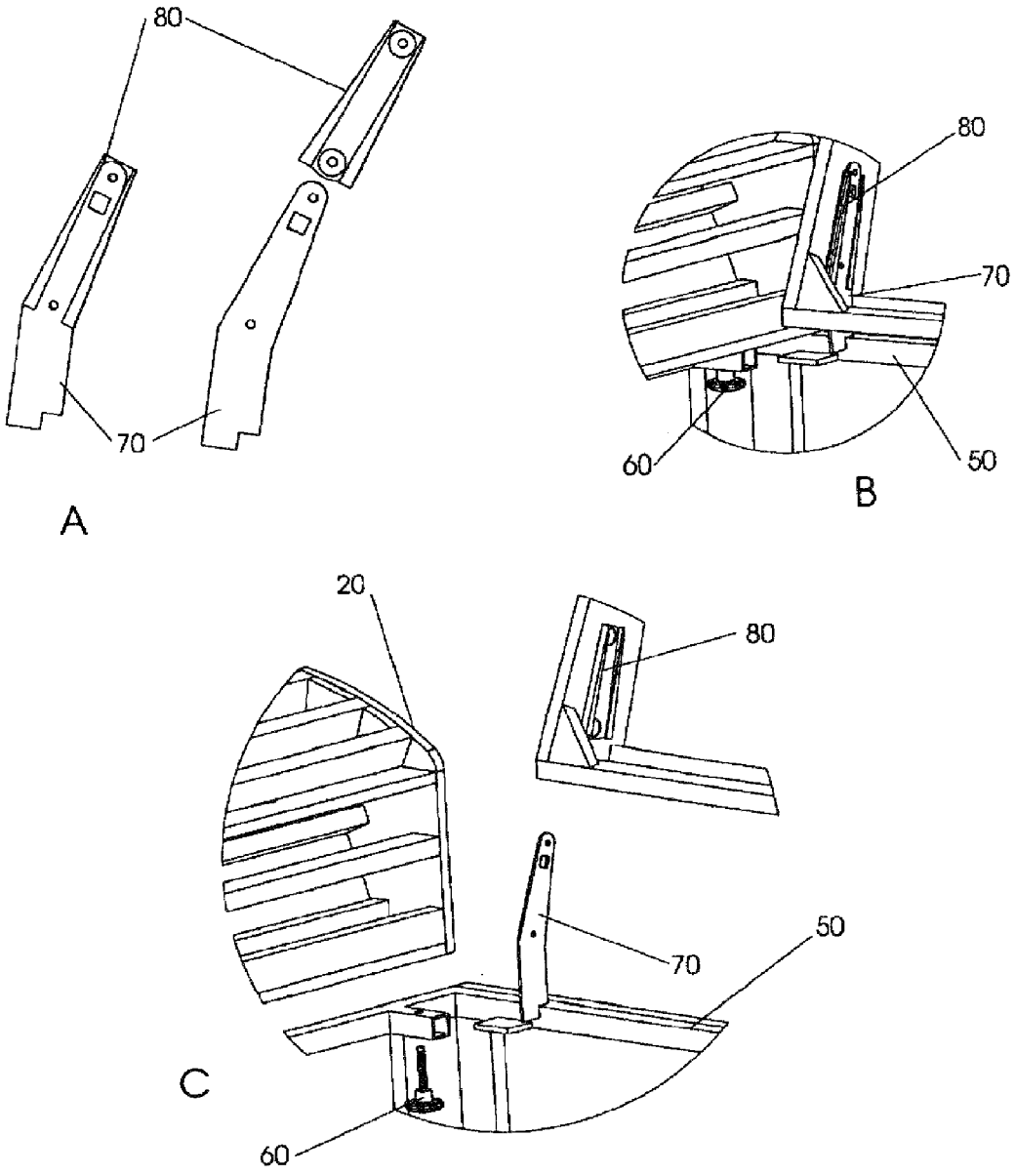
FIG. 3 shows close up views of the male-female connectors (A) for the back frame and the connected arrangement (B) and the disconnected arrangement (C) for the back frame portion of the sofa to the frame.
Figure 20:
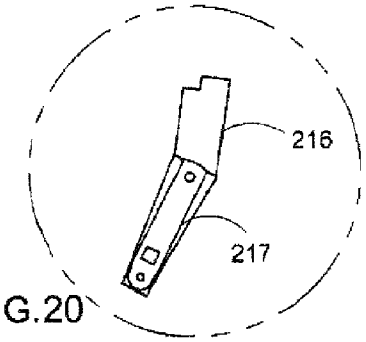
FIGS. 19-21 show expanded view of male-female connectors for back portion connecting to the sofa frame.
Figure 21:
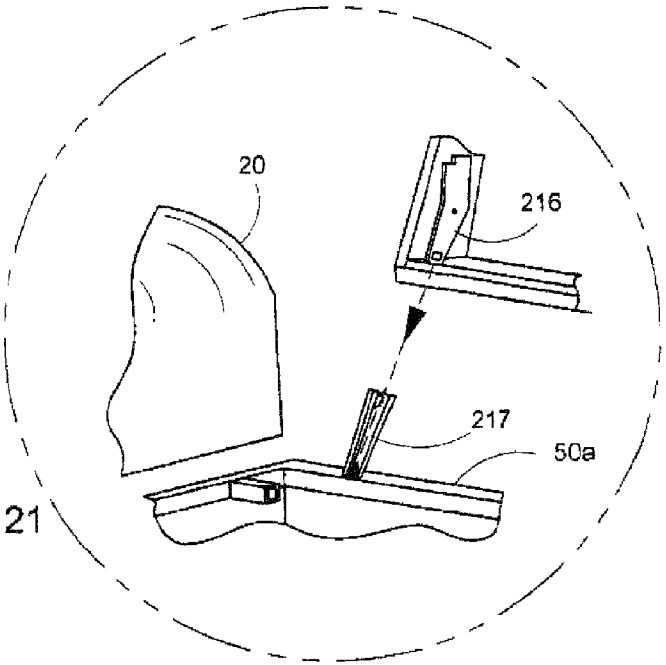
Figure 19:
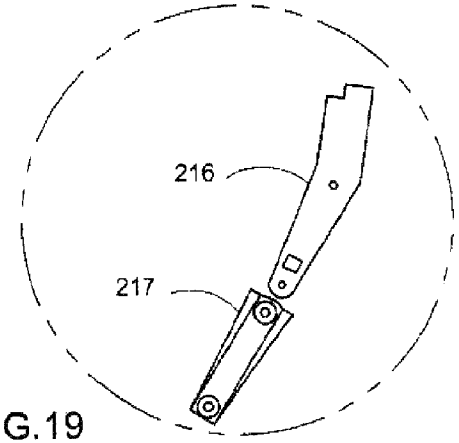

Referring now to FIG. 3A a detail of the embodiment, as is shown in male connector 70, which was shown in FIG. 1 attached to the rear portion of the frame interacts with female connector 80, which was shown in FIG. 1 connected to back frame portion 10. The interaction of the male-female 70 and 80 connection allows the back portion to be secured to the frame. In a preferred embodiment, no tools are required to effectuate the interaction and connection. FIG. 3B shows a view of the male connector 70 and female connector 80 attaching along transverse portion of support frame 50 in their interconnected state and FIG. 3C shows male connector 70 and female connector 80 attaching along transverse portion of support frame 50 in their disconnected positions. Although this connection gives one embodiment of the male-female connector relationship, the invention is not limited to this particular configuration. As seen in FIGS. 19-21, Female connector 217 is connected to rear portion of frame 50 and connects to the back portion through complimentary male connector 216.

Referring now to FIG. 4A, is a cut away view of the upper drawing shows side 20 that will receive mounting screw 60 through an incorporated orifice. The lower drawing shows a close up view of the attachment of side 20. In a preferred embodiment, a T-nut (shown in FIG. 6 close-up) is permanently attached to sidepiece 20 and the inner portion of T-nut creates a complementary threaded orifice to receive the threads from screw 60. In this embodiment, screws 60 have heads suitable for tightening by hand. Also shown in FIG. 4A is support brace 35 which is on the interior of frame 40 and helps to support and stabilize the full assembled system. FIG. 4B further show receiver 65 whereby the shaft of screw 60 is inserted into a central orifice in receiver 65 and the shaft interconnects with T-nuts located within channel 75 incorporated into sidepiece 20.

Figure 5:
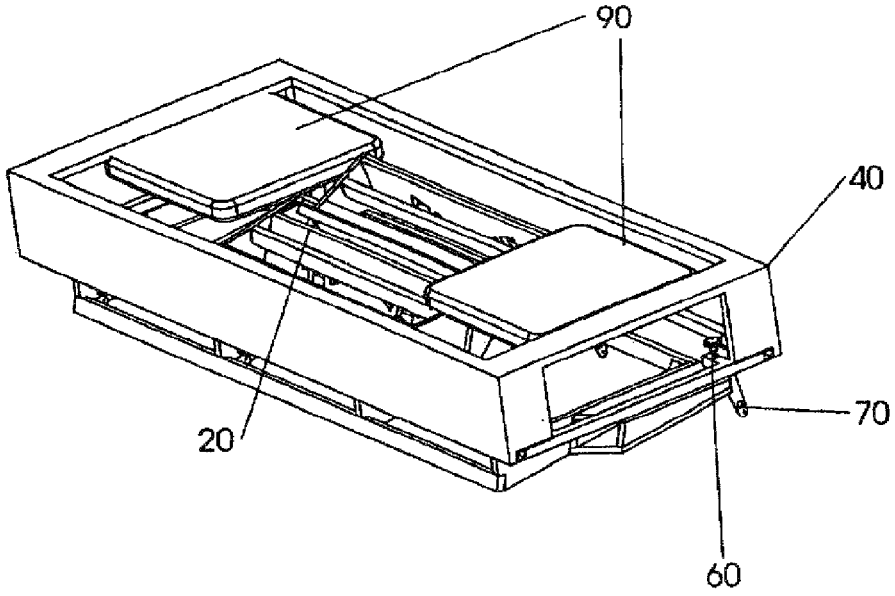
FIG. 5 shows an alternative embodiment whereby side pieces and cushions nest within a cavity on the underside of the frame for shipping. The cushions are vacuum packaged to reduce volume of space needed for storage and shipping.

In an alternative embodiment of this invention shown in FIG. 5, the entire article of RTA furniture is in a stacked configuration, with the interlocked arms 20 and cushions 90 stored in the storage cavity. Cushions 90 may be placed in a vacuum sealed bag to reduce the volume required and make them smaller to ship because typically, cushions are foam or feather and contain a significant volume of space occupied by air. Removing the air reduces the volume required to store and ship cushions 90. In this alternate embodiment, the back assembly, the back and seat cushions and the arm assemblies may be vacuum packaged separately or in combination.

Figure 6:
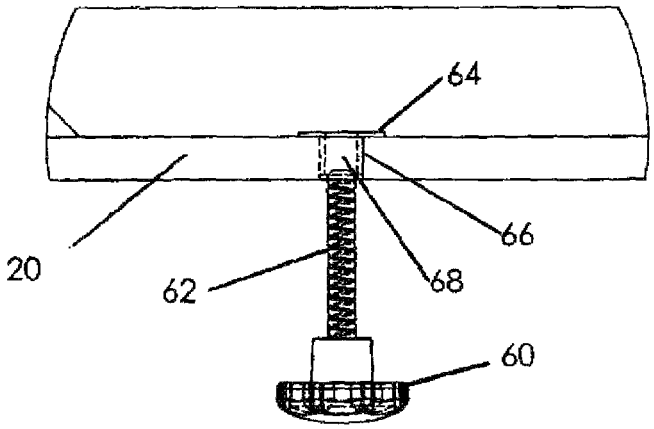
FIG. 6 is a close up partial cross section showing connection of a screw attaching into a t-nut set into a sidepiece.
Figure 7:
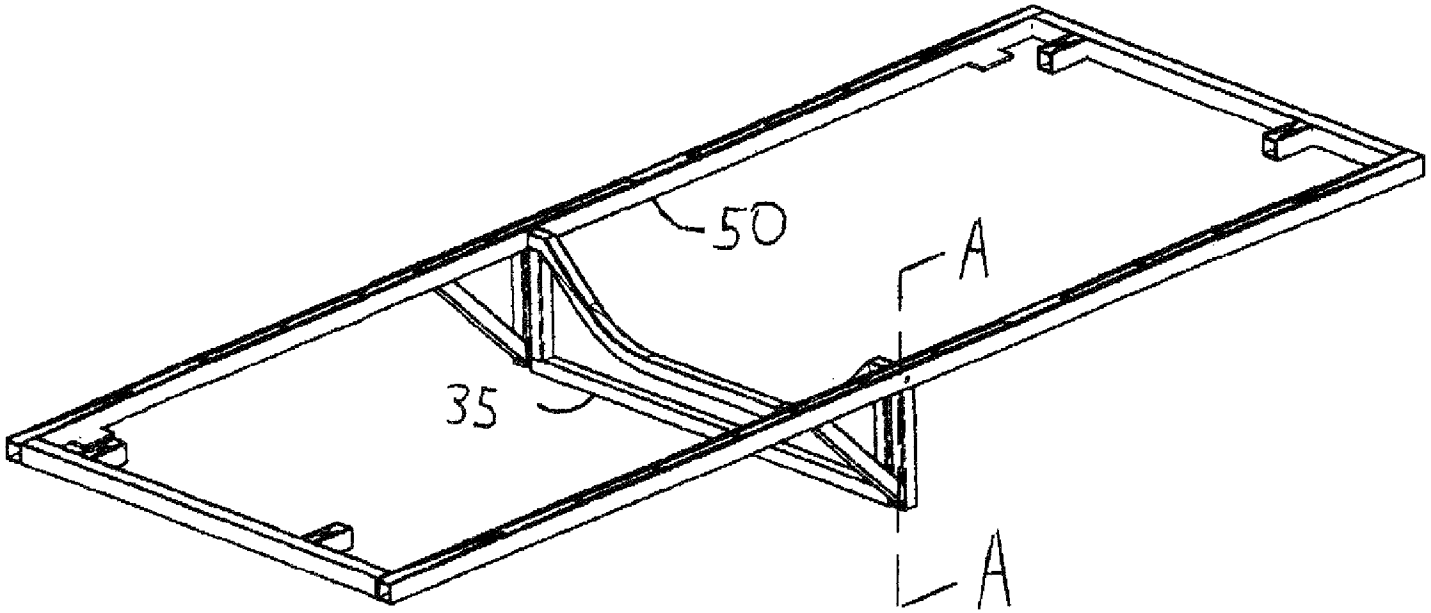
FIG. 7 is a perspective view of the support frame with a swivel swing gate in a vertical position relative to the frame.
Figure 8:
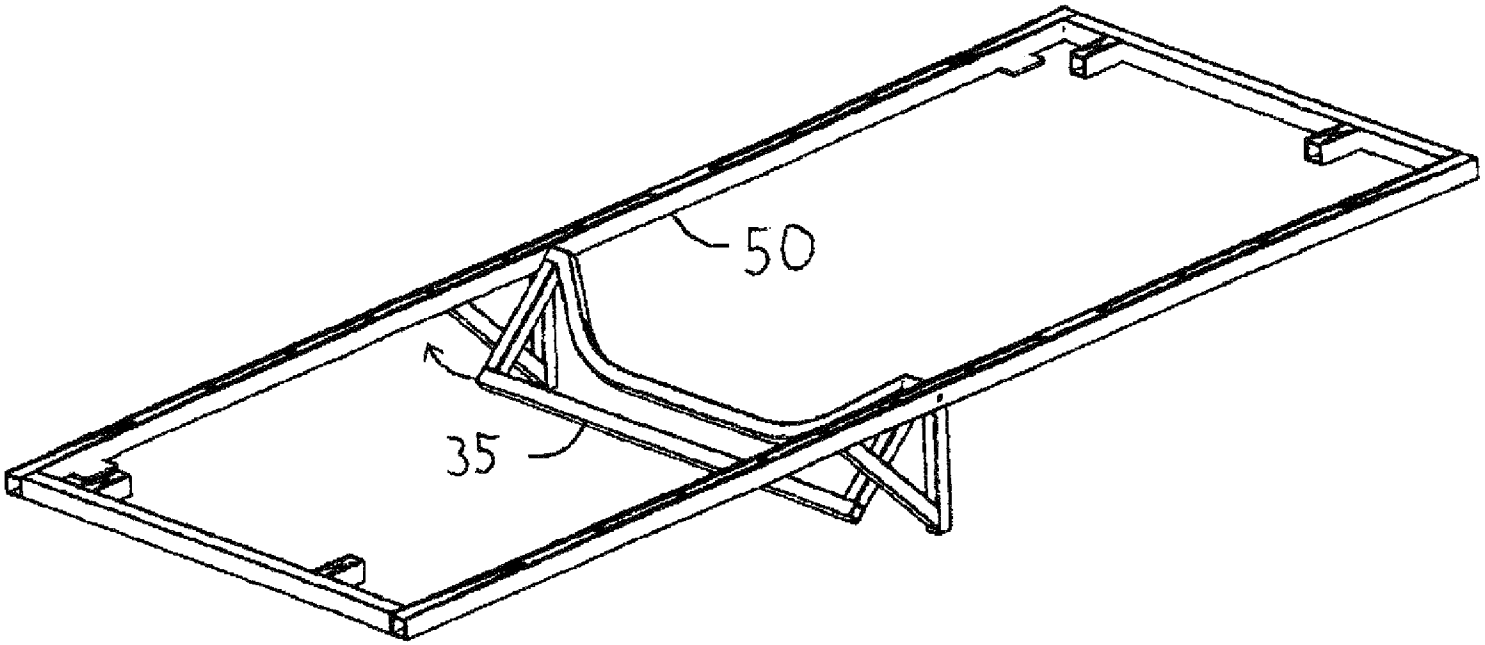
FIG. 8 is a perspective view of the support frame with a swivel swing gate moved along directional arrow from a vertical position relative to the frame.

Referring to FIG. 6, a T-nut 64 is mounted onto sidepiece 20 in channel 75 (previously shown). The t-nut 64 has inner circumferal threaded portion 66 that forms a circular channel 68. The inner circumferal threaded portion 66 interacts with the screw threaded shaft 62 of screw 60 and serves to secure sidepiece 20 onto the aforementioned frame. Referring to FIGS. 7-8, support brace 35 is a swivel swing gate that supports frame 50 in a vertical orientation and pivots to a horizontal orientation resulting in an unobstructed cavity within the sofa frame. FIGS. 7-8 show progressive steps of swivel swing gate moving from vertical to horizontal orientations.

In assembling a preferred embodiment, the article of the present invention, the components are separated and the frame is placed in an upright position, e.g. positioned upright so as to receive the component parts and be usable upon assembly. Back portion 10 is connected to the back frame 50 using the male-female connectors described. Then each sidepiece is connected to the frame through use of hand screws interacting with T-nuts permanently mounted into incorporated orifices into each of said side pieces. An appropriate support may then be attached to the frame to hold desired seat portions and/or cushions. The assembled system may now receive any appropriate upholstery covering for the side and back portions. As previously mentioned, the assembly of the present invention may be assembled without the use of tools. Many RTA products require numerous component parts, tools, and take a significant amount of time and effort to assemble. The RTA system of the present invention provides not only a cost savings in shipping, but also a savings in labor for assembling. One the article is unpacked from shipping configuration; it comprises 4 major components and assembles quickly. Attach the back with the aforementioned male-female connectors, attach each of the sidepieces and secure with hand screws, and the RTA assembly is completed. Additionally, the manufacturing costs are reduced because the majority of the system is assembled from 4 major components.

Assembly of the system of the present invention on a commercial scale is also economized because any assembly line processes can be done quickly and without the use of tools.

Figure 9:
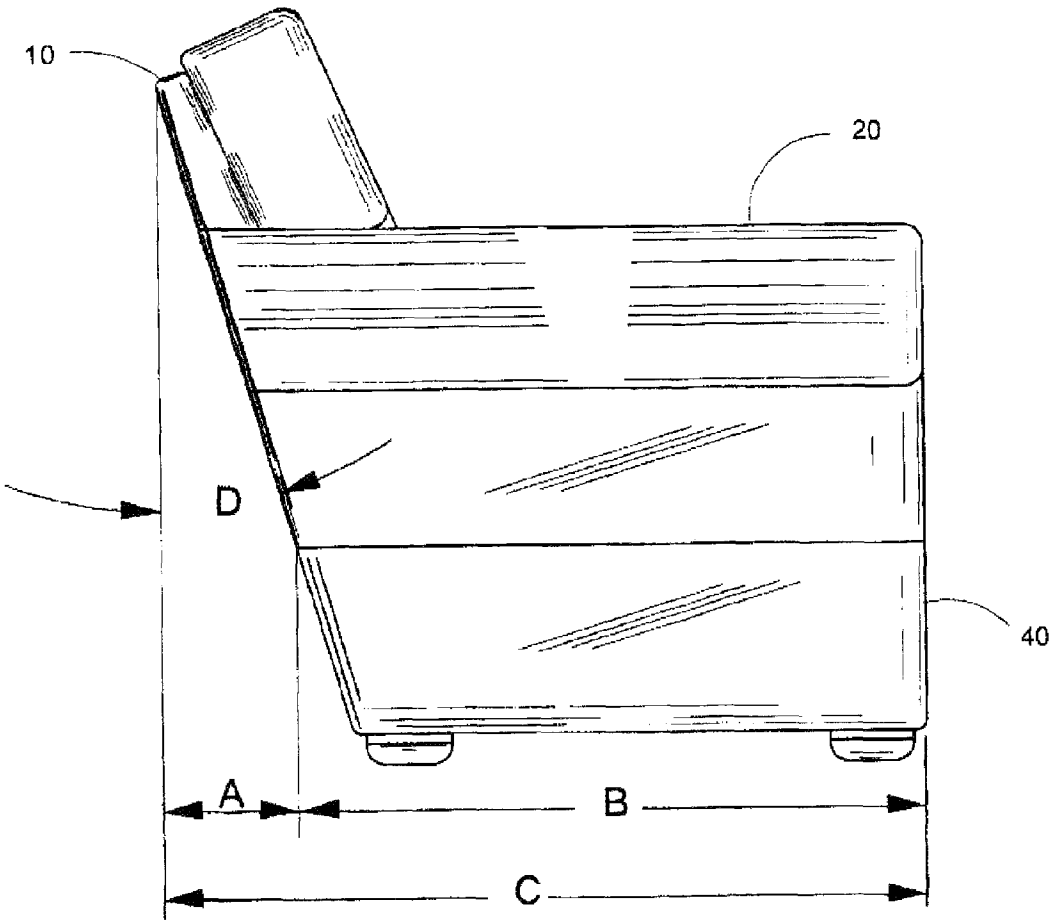
FIG. 9 is a side view of an assembled sofa.

In one embodiment, as shown in FIG. 9, the assembled sofa has a back 10 with an angular deflection "D" relative to a perpendicular line from the top of back 10 to the floor below. In conventional sofas, the back portion is substantially vertical. The present invention provides, angular deflection that allows a back portion to extend beyond the periphery of the frame. In one embodiment, the angular deflection is from about 10° and 35° relative to a perpendicular line to the horizontal frame and towards the front on the sofa, as indicated by dimension "D" in FIG. 9.

Part of the tilt is in the frame 10 and the remainder of the angle is provided by construction of the back portion. A typical sofa has a frame of depth "C". In providing a sofa in the present configuration, instead of requiring shipping of a frame with depth "C", distance "A" is not required in the depth of the frame such that the frame only has a depth "B" and provides a shorter depth which is advantageous in packaging the sofa for shipping.

Figure 10A:
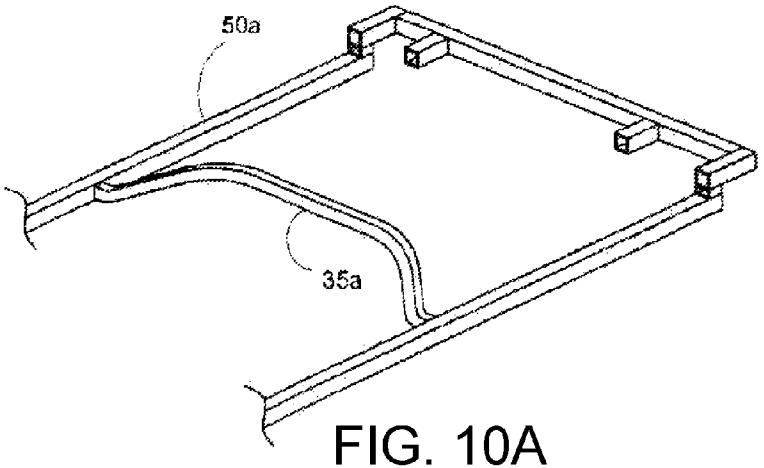
FIG. 10A is an expanded view from FIG. 10 showing the movement of the swivel swing gate in the frame.
Figure 10:
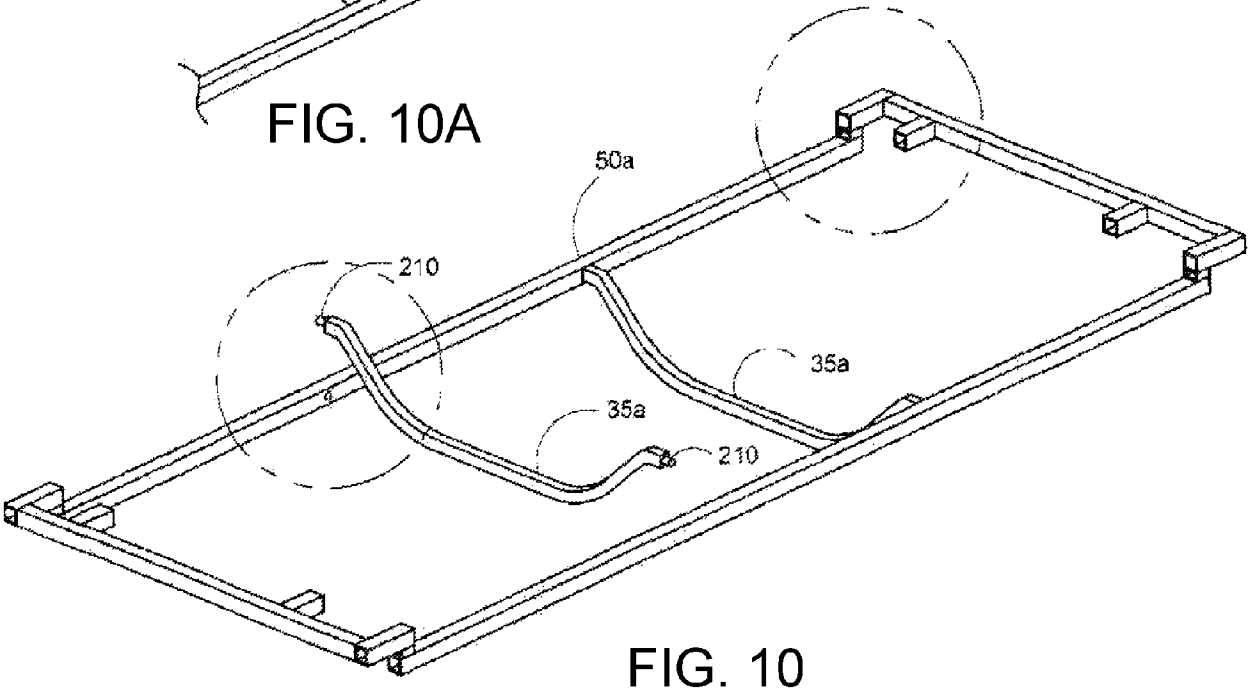
FIG. 10 is a perspective view showing a sofa frame with end portions in an elevated horizontal plane relative to the longitudinal portions connecting each end portion.
Figure 22:
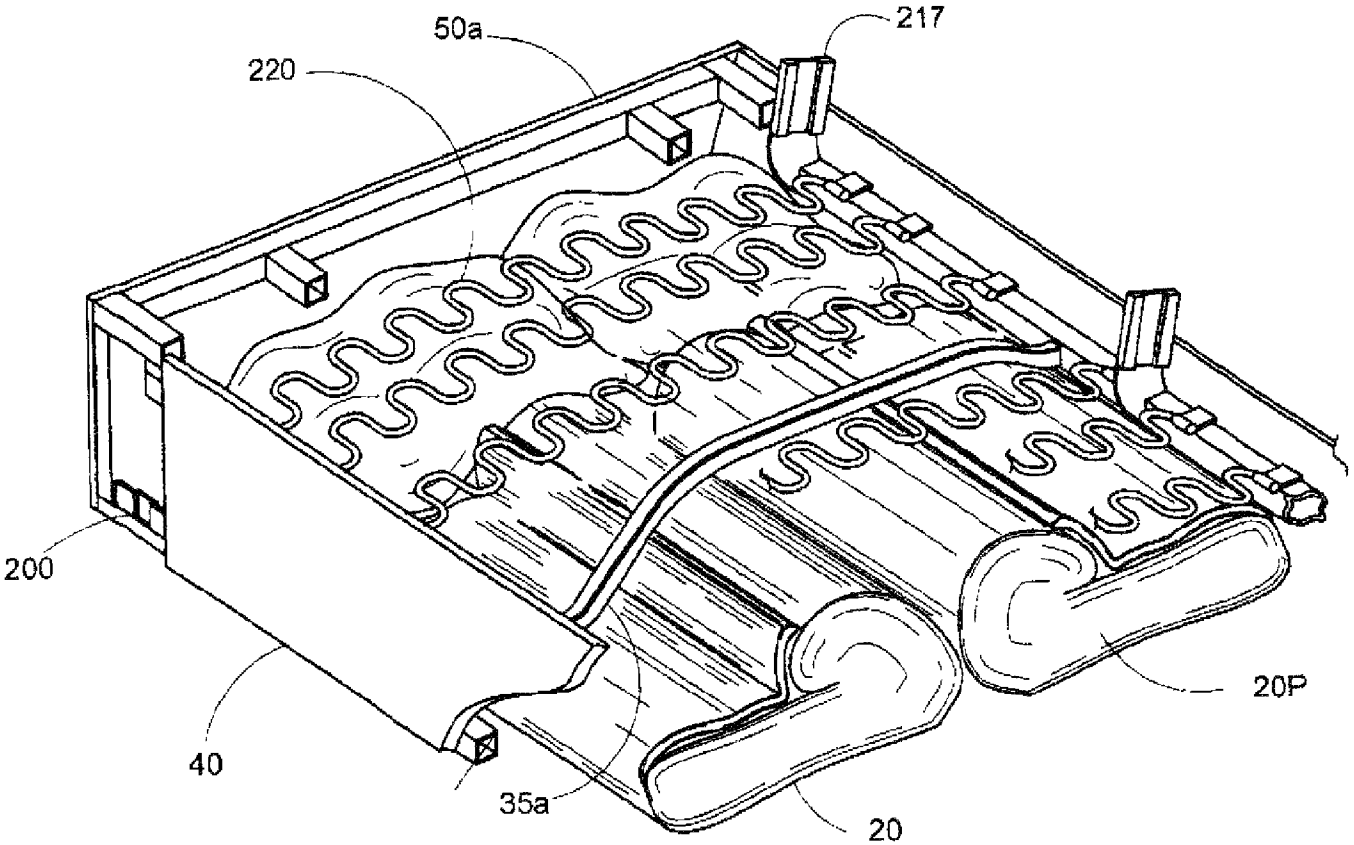
FIG. 22 is a partial perspective view showing the horizontal offset utility in accommodating storage in the cavity when a support spring is present.
Figure 23A:
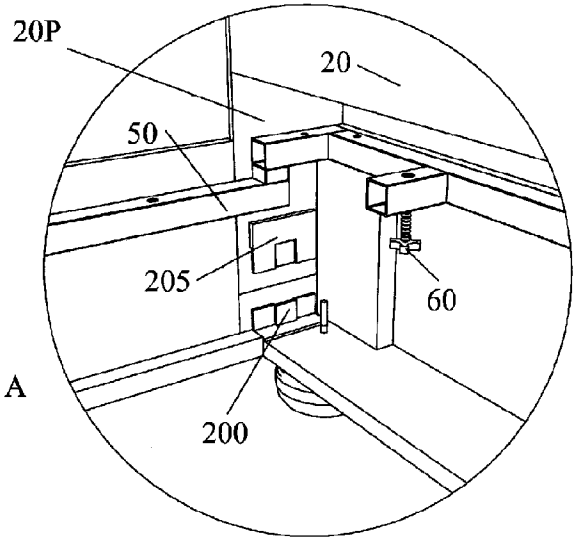
FIG. 23A is an expanded view showing connection of side arm portion to frame.
Figure 23B:
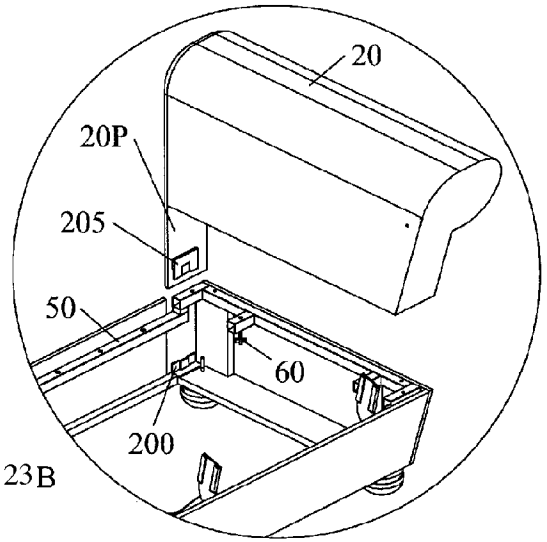
FIG. 23B is an expanded view showing connection of side arm portion to frame.

The present invention includes an offset frame configuration as shown in FIGS. 10, 10C, and 10D. Frame ends pieces 50*b* are offset above the horizontal plane along the top of long frame member 50*a* by a distance represented by dimension "R". In one embodiment, the distance of dimension "R" is between about 0.5-2 inches. The offset has been shown to accommodate the unassembled configuration desired in the present invention when support spring 220 as shown in FIG. 22, is present. This allows for the storage of arms and cushions in the cavity without need to remove support spring 220.

As shown in FIGS. 10A&10B, and 10D, one embodiment provides a swivel pin 210 on swivel swing gate 35*a* that inserts into pin receiving socket 210*a*. Receiving socket is any acceptable complimentary structure for receiving swivel pin and includes an orifice incorporated in frame 50 and structures attached to frame 50 or to long frame member 50*a* for facilitating connection. Furthermore, the male-female relationship may be reversed and the swing gate may have a female swing structure, such as an orifice and the like and the frame a male connector, such as a swivel pin. Additionally, although swing gates, as described herein, are shown as rotating about an axis defined by a swivel pin, it is contemplated that other rotational and movement devices that provide the same effect could be used. Movement about a rotational ball and socket, rotational hinges, snap-fit arrangements and the like, as long as they provide for the desired movement of moving the support out of the cavity to provide an unobstructed cavity for storage in the unassembled configuration and placement within the cavity for the assembled configuration. It is desirable that swing gate 35 be positioned between the front and back panels in each of the assembled and unassembled configurations. In an assembled configuration, the swing gate provides the desired structural support of an assembled sofa. In an unassembled configuration, the position prevents the frame from collapsing due to any forces or stresses of shipping.

Figure 11A:
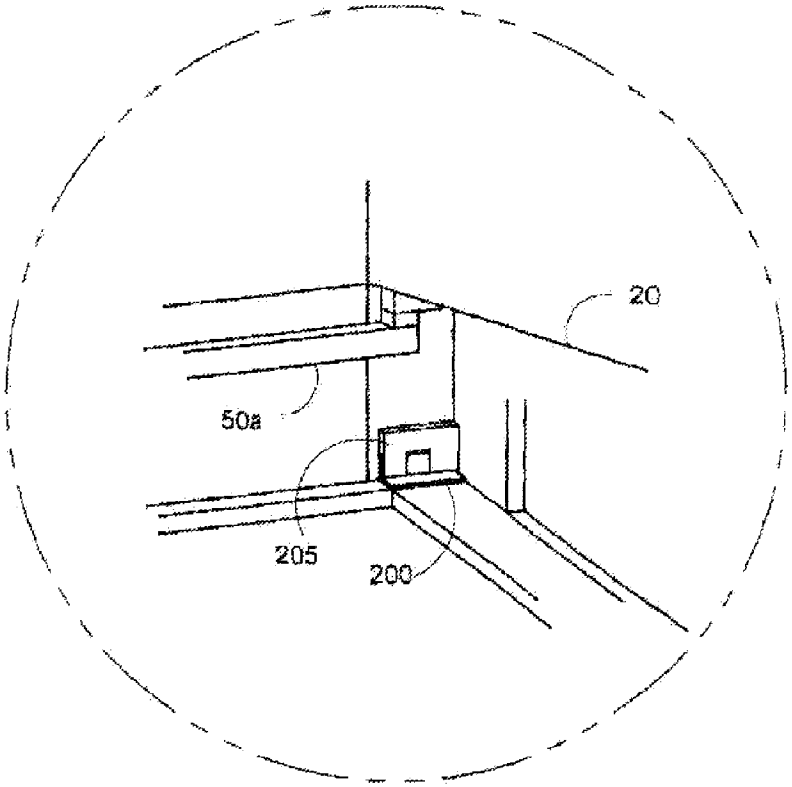
FIG. 11A is a partial expanded view of a corner of the frame with arm side piece connectors.
Figure 11:
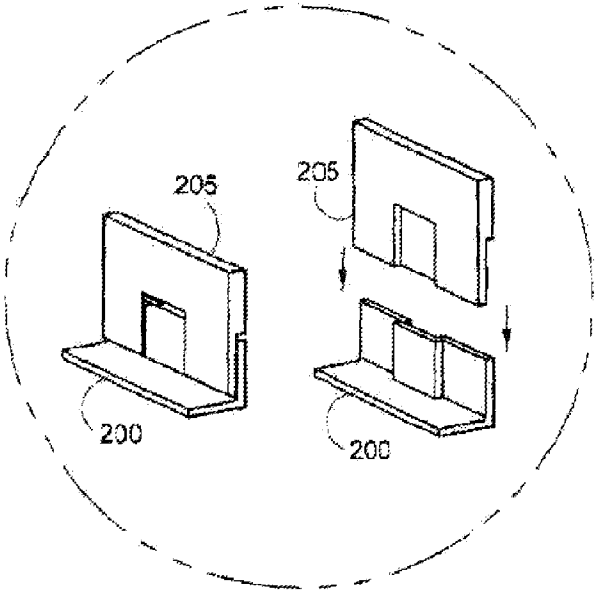
FIG. 11 is a partial expended view of arm side piece connectors.
Figure 12A:
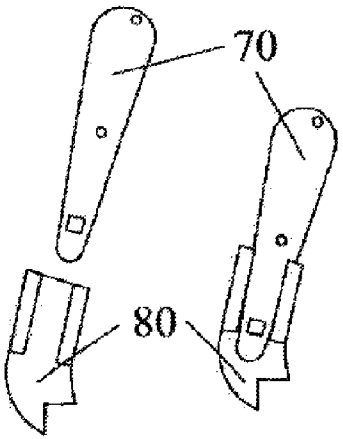
FIG. 12 is a partial expanded view of arm and back portions to be assembled on the frame.
Figure 12B:
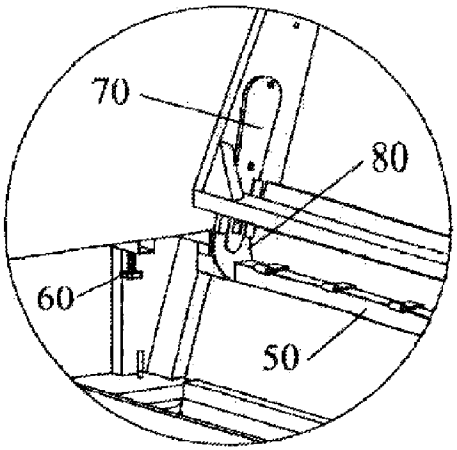
Figure 12:
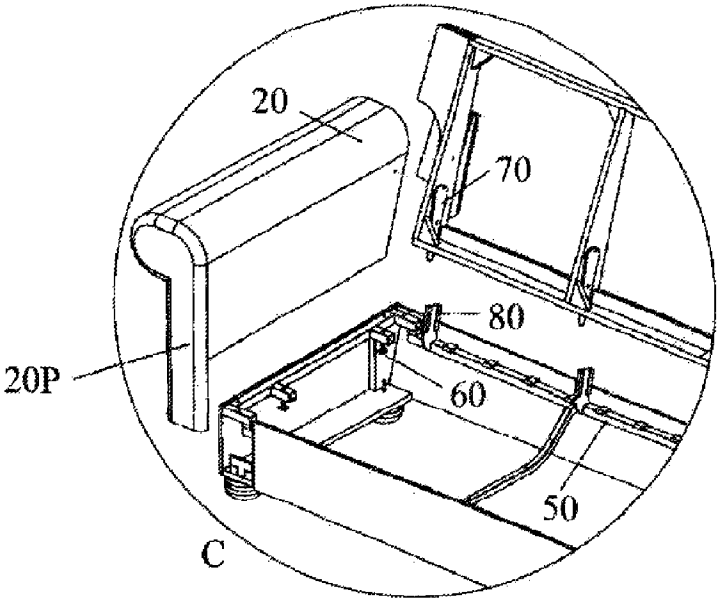
Figure 13A:
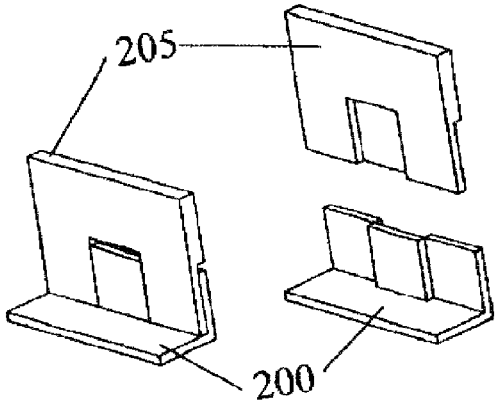
FIG. 13A shows connectors used in attaching side arm portions.
Figure 13B:
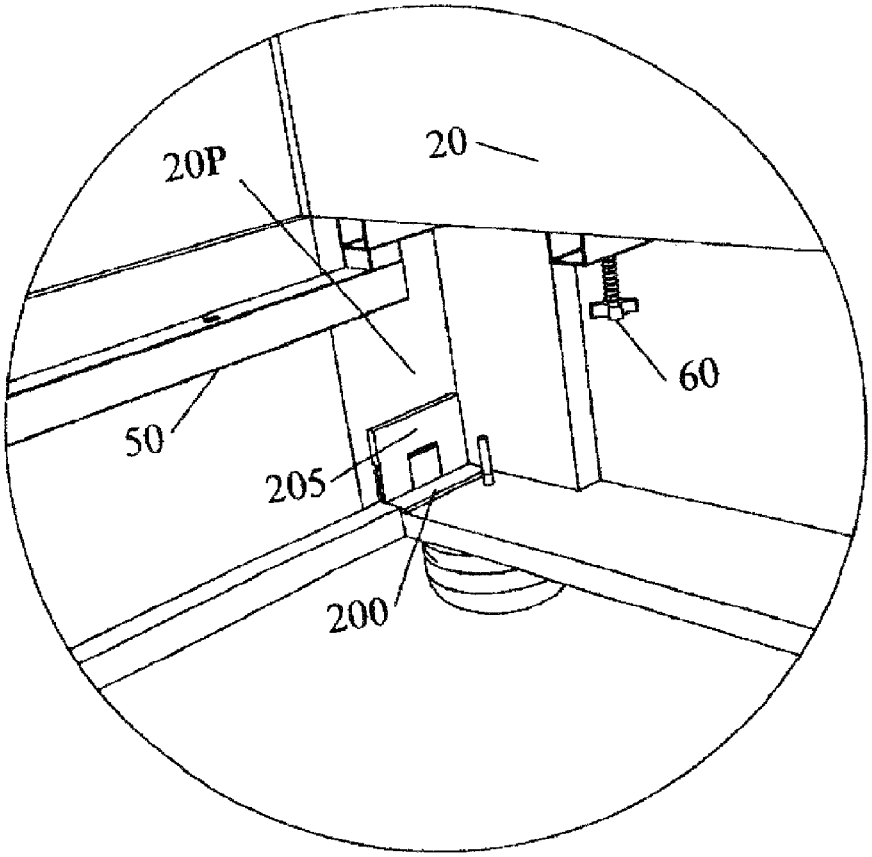
FIG. 13B is an expanded view showing arm portion attaching to frame and secured with connectors from FIG. 13A.
Figures 14, 15, 16, 17, 18:
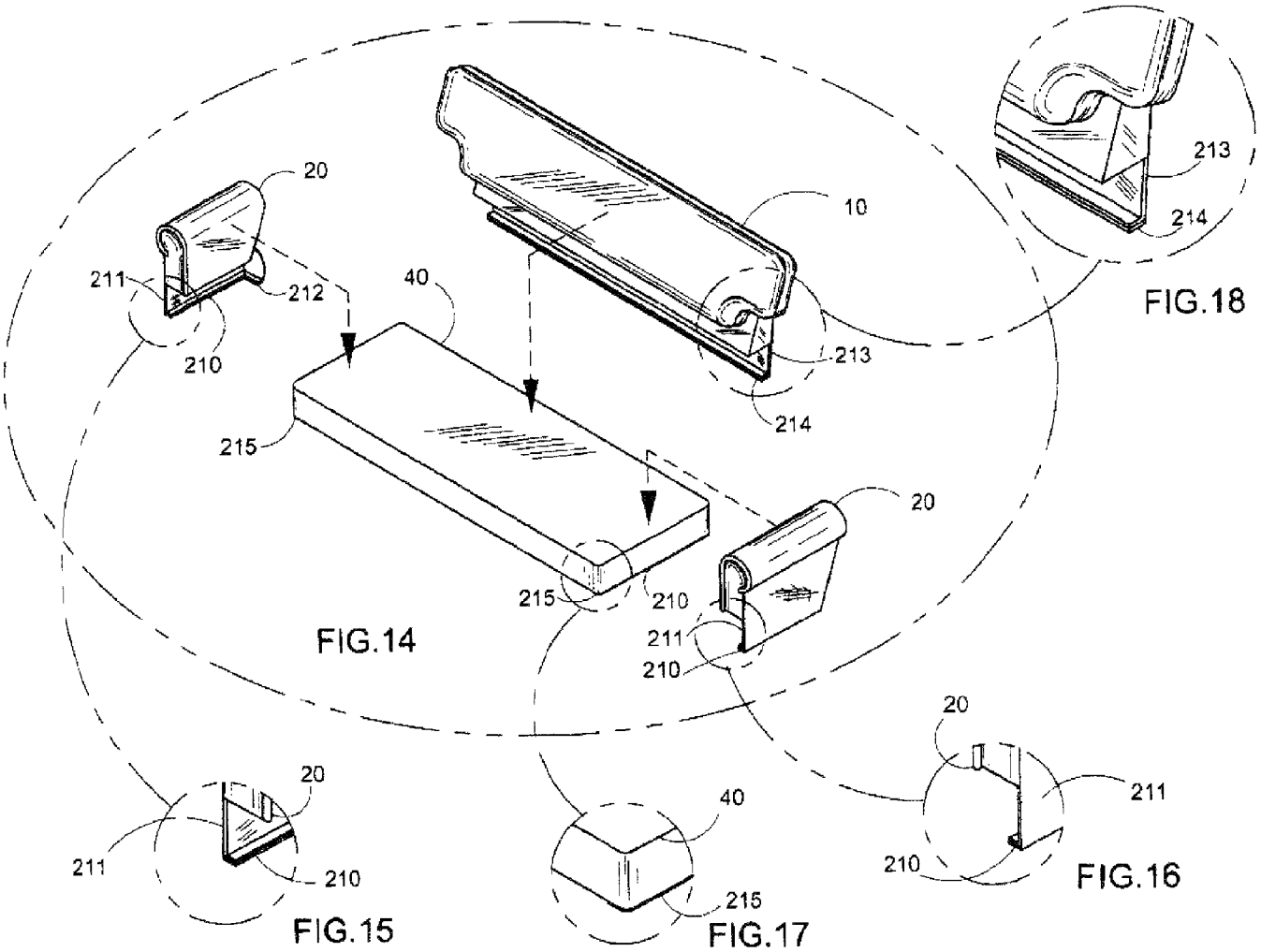
FIG. 14 shows a disassembled sofa and directional arrows for component placement.
FIG. 15 is an expanded view of arm extension.
FIG. 16 is an expanded view of arm extension.
FIG. 17 is an expanded view of a corner of the frame.
FIG. 18 is an expanded view of back portion placement.

In some embodiments, as shown in FIGS. 14-17, arm piece 20 is constructed and arranged such that attachment to the frame is on the topside of frame 50 where the underside of arm side piece 20 attaches along the top of frame 50, and arm side piece 20 has a side extension portion 211 in which lip 212 secures under frame edge. The lip 211 provides a region where a covering placed on arm side piece 20 is attached such that said attachment is not visible in the assembled configuration. Additionally, back piece 10 is now similarly constructed with an extension member 213 terminating in lip 214. Lip 214 provides an area for attachment of covering material over back portion 10 such that the attachment is not viewable in the assembled configuration. Covering 215 covers the frame and panel and has closure underneath the sofa such that the closure seam is hidden from view. Attachment of a covering over each of side pieces 20 and back piece 10 are performed in manners known in the art such has hook and loop fasteners, snaps, zippers, and the like. The shape and configuration provides the advantage that in an assembled configuration, the point of attachment is not easily seen or readily apparent. Similarly a covering material 215, as seen in FIGS. 14 and 17, covers the frame. Also, as shown in FIGS. 11 and 12C arm side piece 20 has a forward extension 20P constructed and arranged to extend along the vertical face of the assembled frame. On the interior portion (the surface facing the sofa frame) 20P has incorporated thereon connector 205 that fastens to complementary connector 200 to provide a fastening of side arm piece 20 to the assembled sofa and further provides additional strength and support to the assembled structure. In one embodiment, the connector 205 attached to 20P and connector 200 attached to the frame, are complimentary male-female connectors. They may also be male-female connectors with a snap-fit configuration.

In one embodiment, side arm portion 20 connects on top of the base to keep the height of the arm (20) short in height so that both arms side portions 20 can be packed in an unassembled configuration side by side within the cavity in the unassembled configuration. This saves space to allow packing cushion and other parts within the cavity in the unassembled configuration. Arm portions 20 can further be provided completely upholstered or semi upholstered with removable upholstery positioned such that assembly portions on arm portions 20 are accessible.

Figure 24:
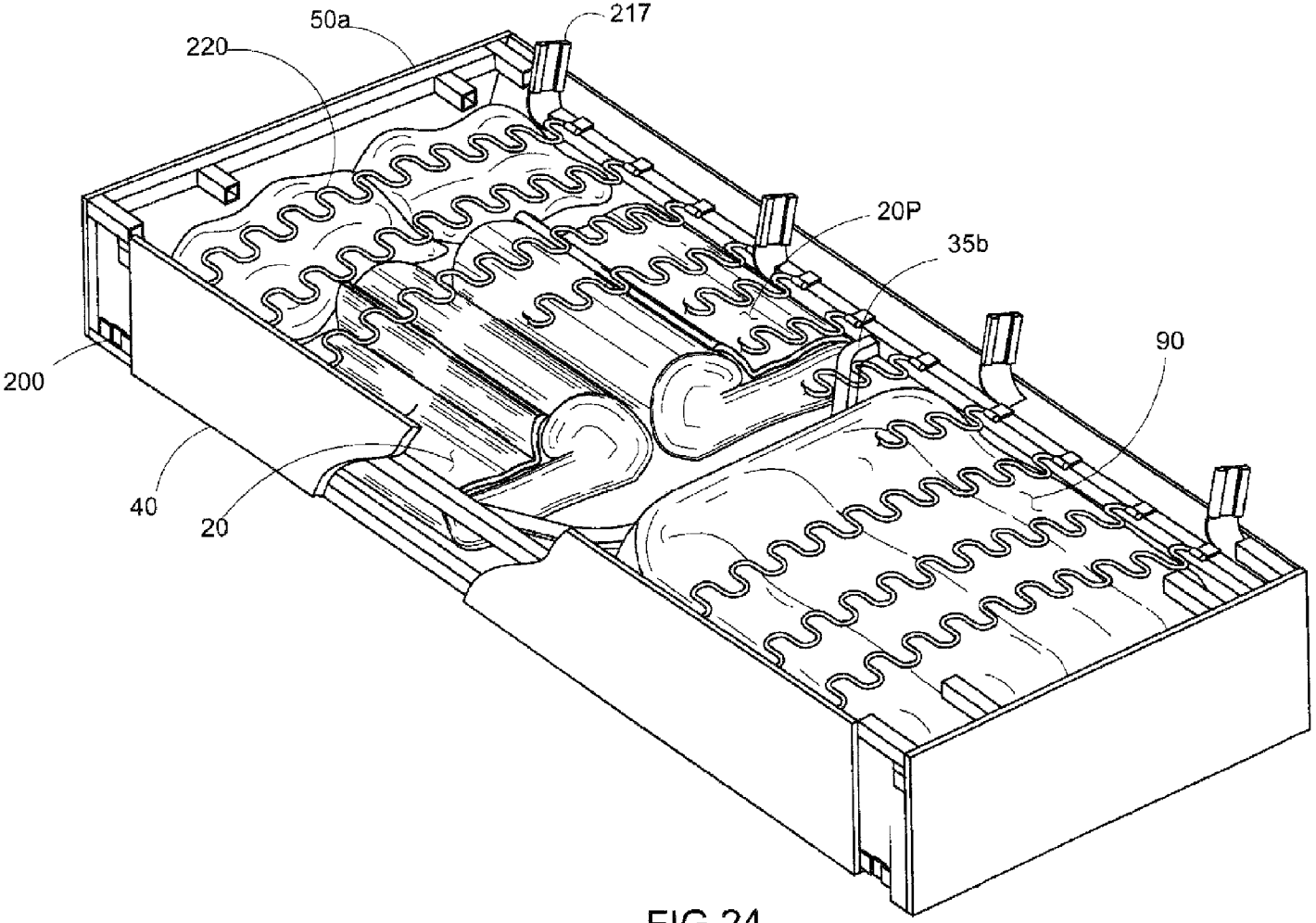
FIG. 24 is a perspective view showing arms and cushions nested within a frame.
Figure 25:
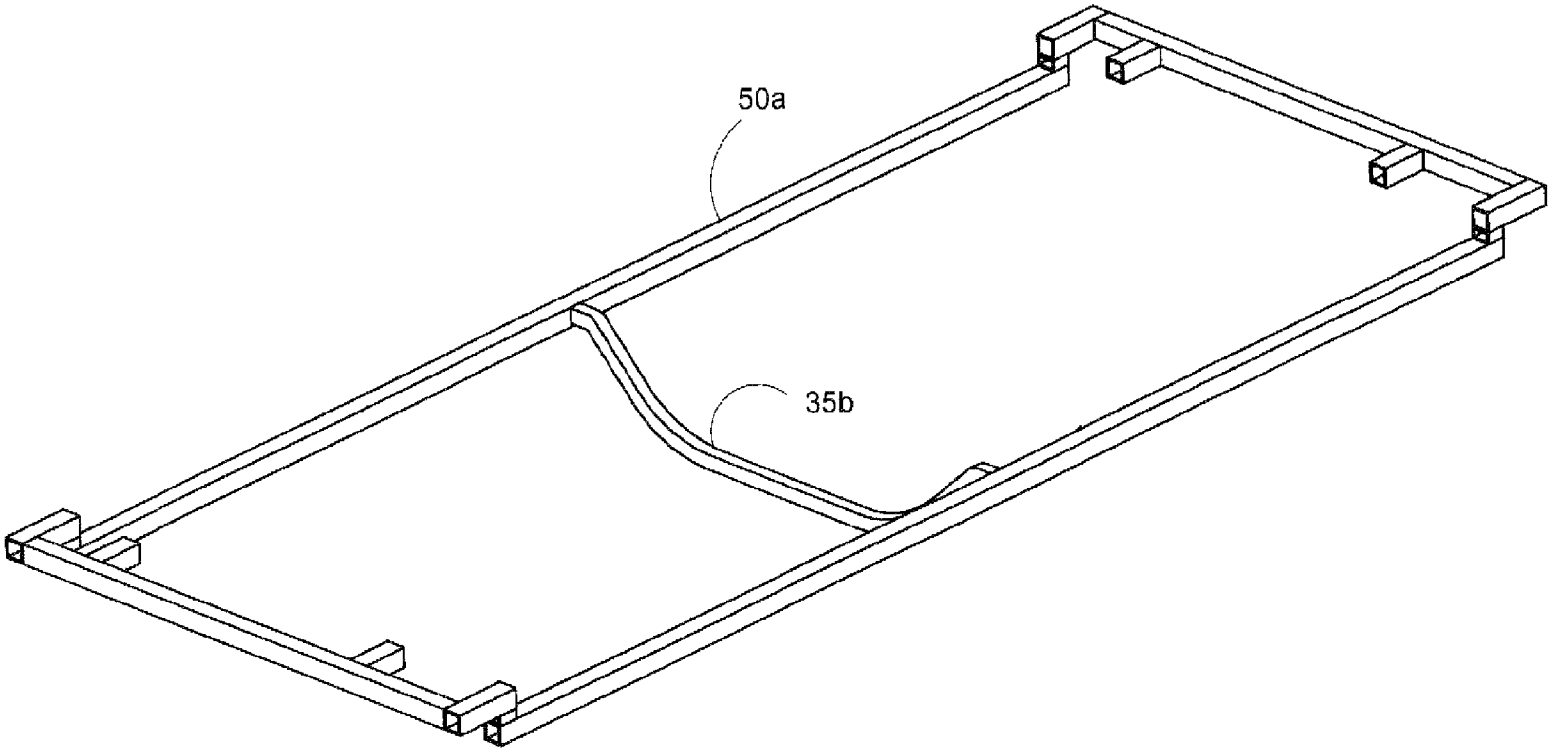
FIG. 25 shows the frame with central support member.
Figure 26:
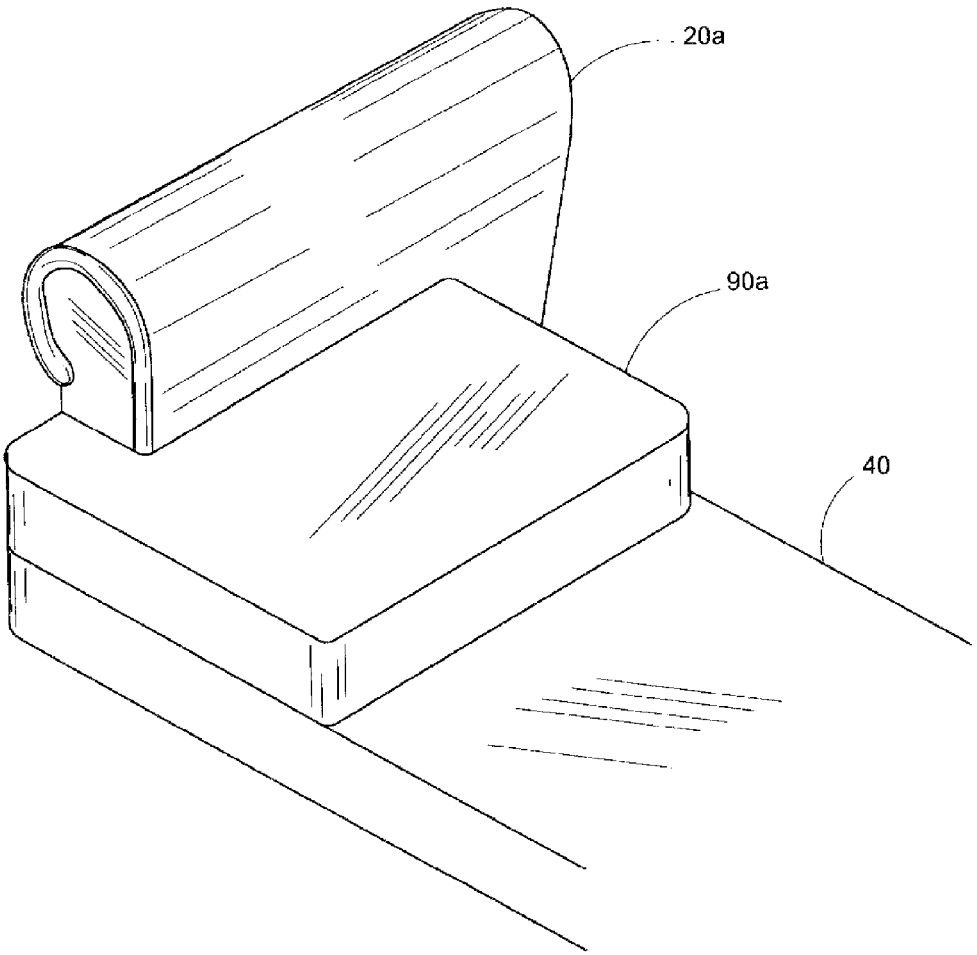
FIG. 26 is a partial perspective view of the sofa of the present invention wherein the cushion is configured to wrap around the front of the arm piece.
Figure 27:
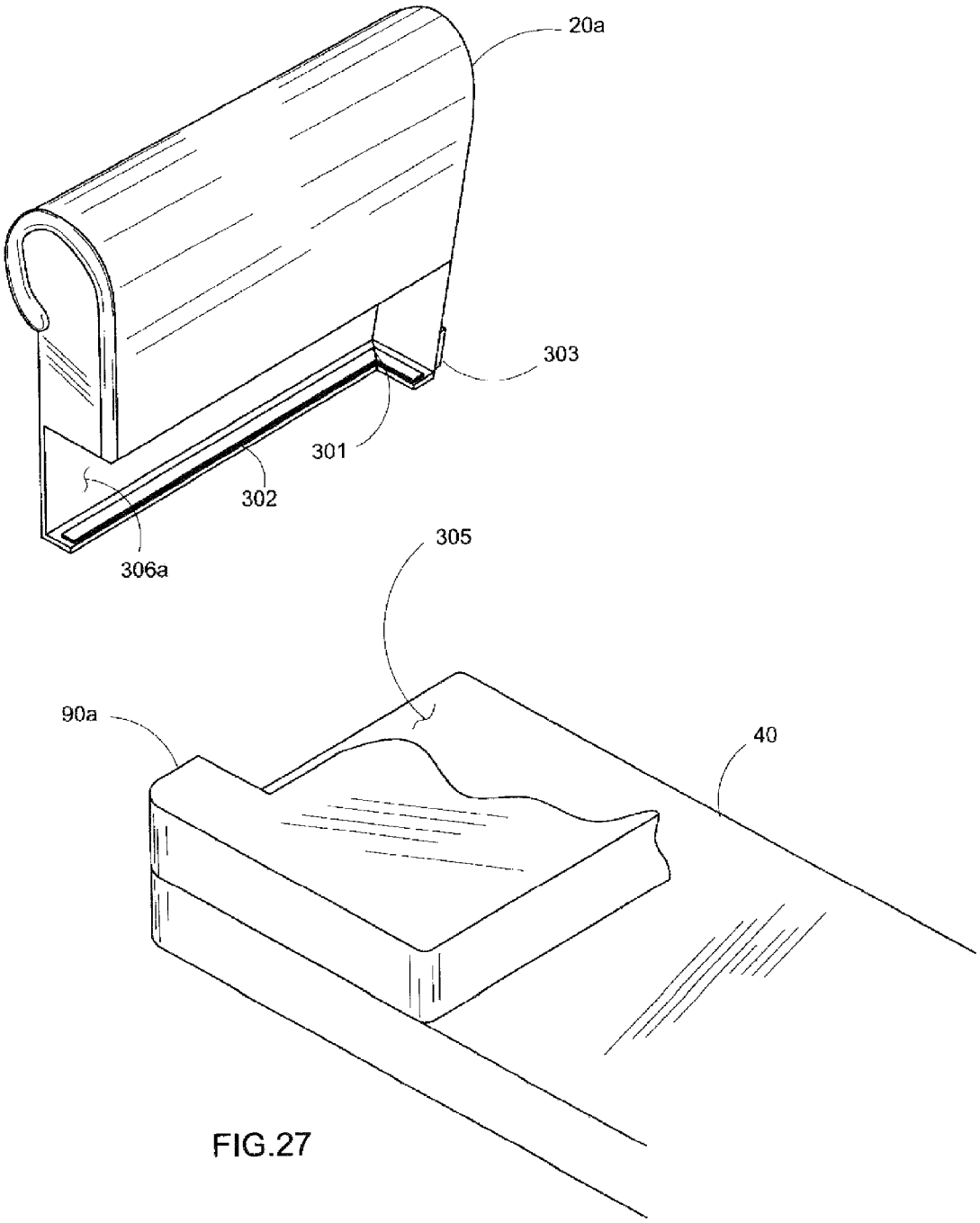
FIG. 27 is a separated partial perspective view showing arm portion 20A separated from frame 40.

In one embodiment, as shown in FIGS. 24 and 25, rigid central support 35*b* is fixed and does not move. While there are distinct advantages to the swivel gate 35 as described herein, the present invention has a configuration in which the central support is rigid central support 35*b*. The present invention recognizes that the basic support frame 50*a* must have transverse support extending generally perpendicular from the front to the back of frame 50*a*. Each arm section 20 is constructed and arranged such that in an unassembled configuration, they will nest within a portion of the cavity defined by rigid central support 35*a*.

In this embodiment, the overall purpose of having an unassembled configuration in which components nest within the cavity is still achieved without the need for the swivel swing gate. Cushions 90 are similarly configured to nest within a portion of the cavity defined by rigid central support 35*a*. Although described as a "central support" it is not necessary that rigid central support 35*a* be precisely centered and may be somewhat off centered by +/−20% of the length the long side of the frame while still being substantially perpendicular to each of the front and back longitudinal sides. In one embodiment, cushion 90*a* is configured to extend around the front of arm piece 20*a*. In another embodiment, cushion 90*b* is flush along the length of arm piece 20*b*.

In one embodiment, the present invention includes each arm section 20 configured to attach on top of support frame 50*a*.

Figures 32, 33:
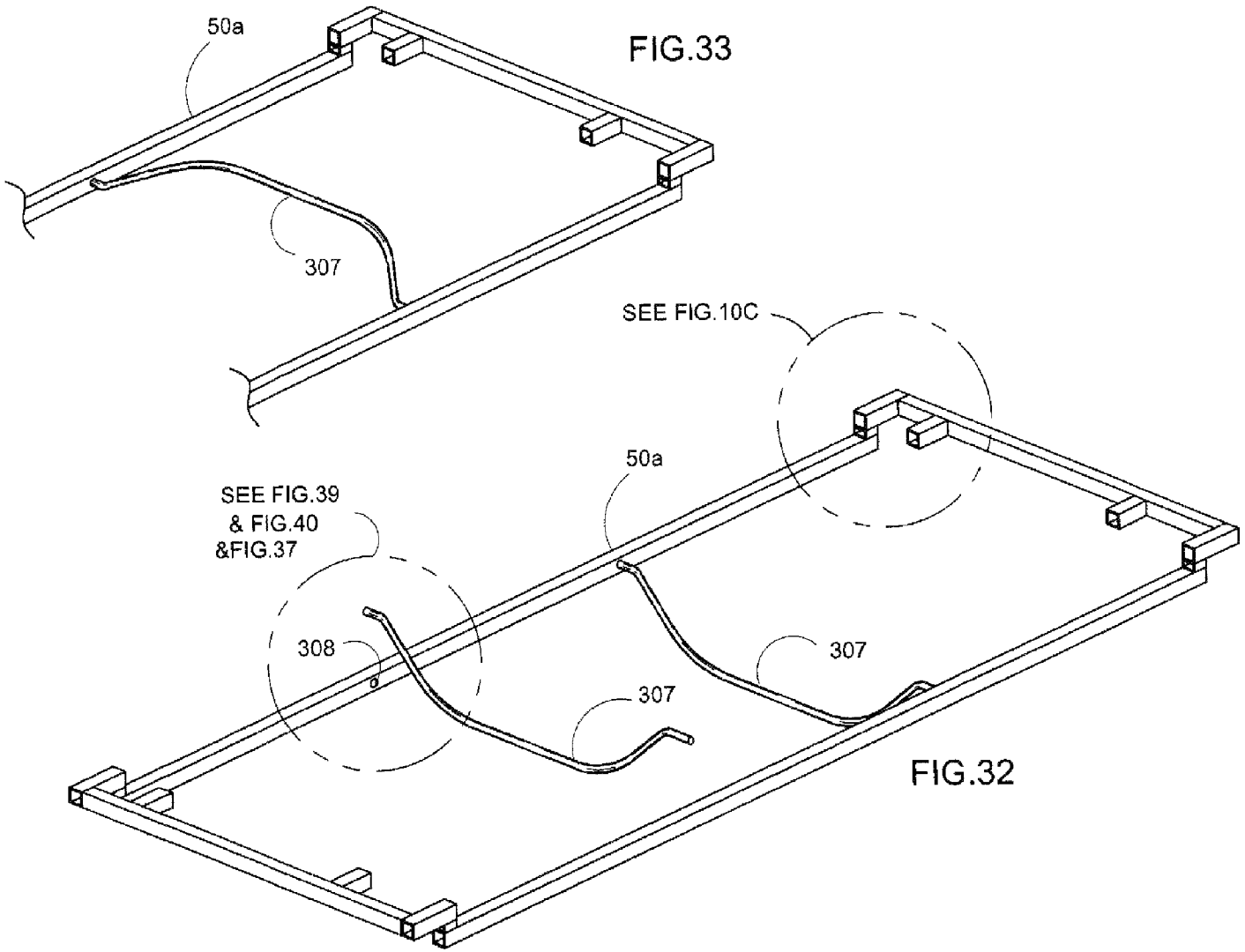
FIG. 32 is one embodiment showing swivel swing gate of the present invention with an orifice in the frame for receiving a swivel swing gate swivel pin.
FIG. 33 is a partial view showing swivel swing gate in an upright position so as to not interfere with storage within the storage cavity.
Figure 35:
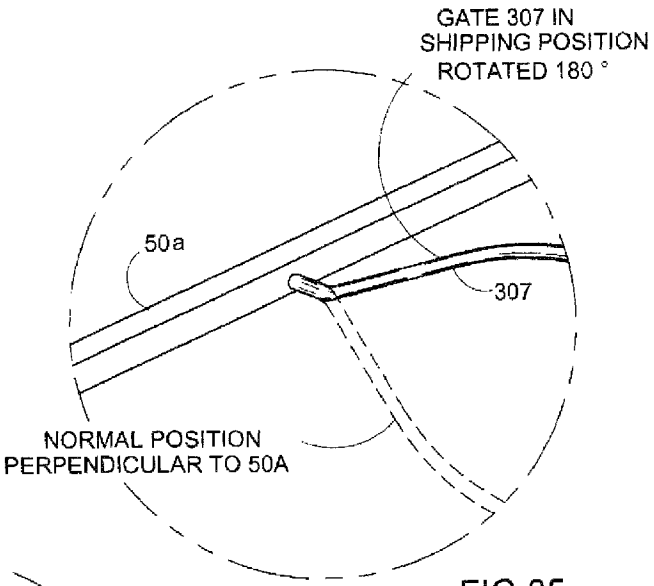
FIG. 35 is an expanded view showing the swivel swing gate rotation of the present invention rotating on a swivel from perpendicular downward, to parallel with the horizontal frame, to perpendicular upward relative to the frame.
Figure 34:
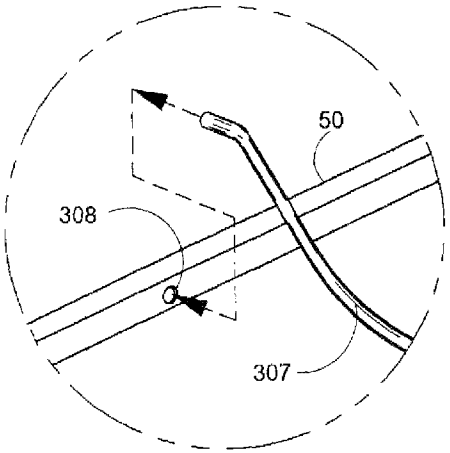
FIG. 34 is expanded view of the swivel swing gate of the present invention.
Figure 36:
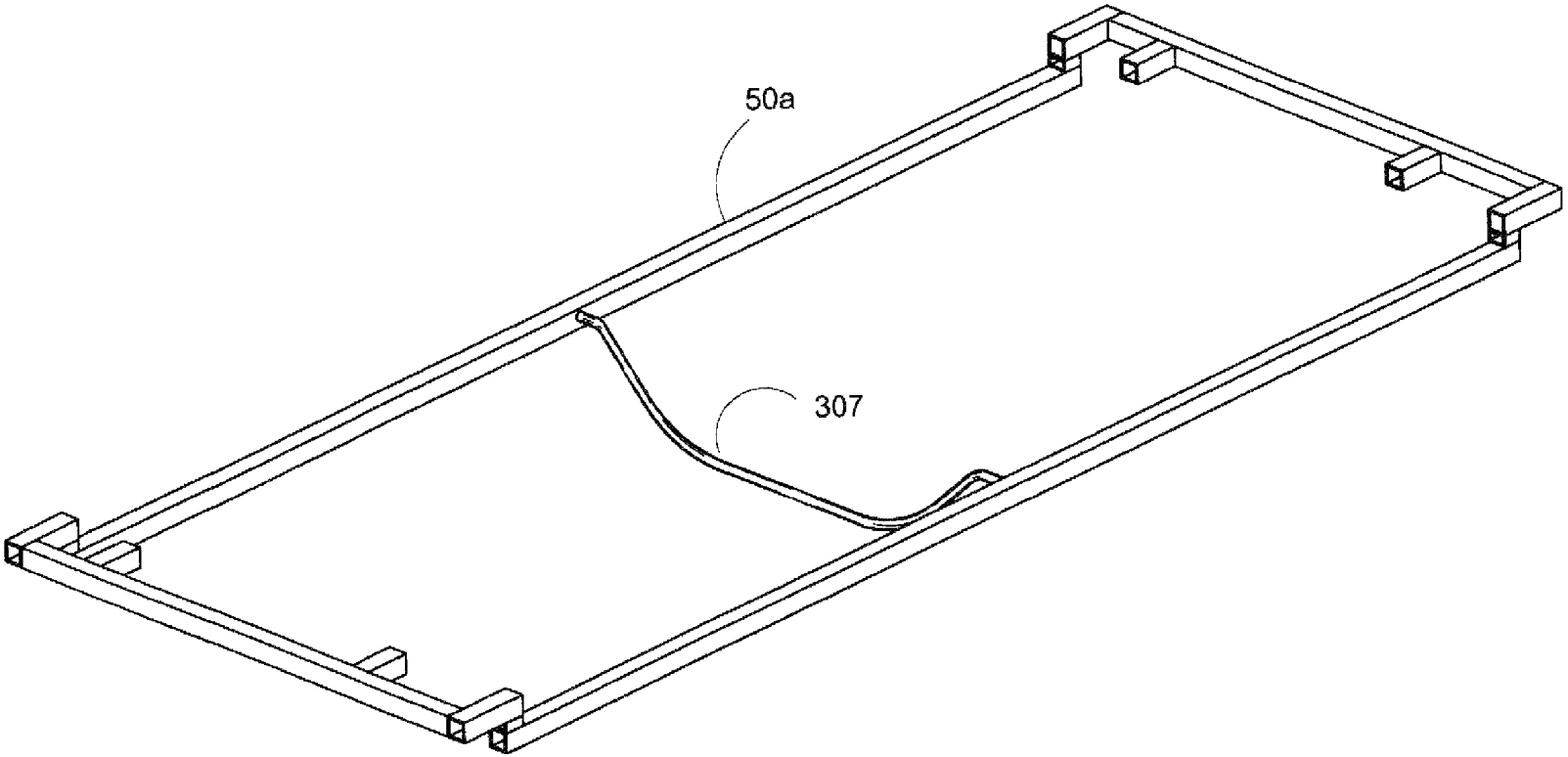
FIG. 36 is a perspective view of the frame of the present invention.
Figure 37:
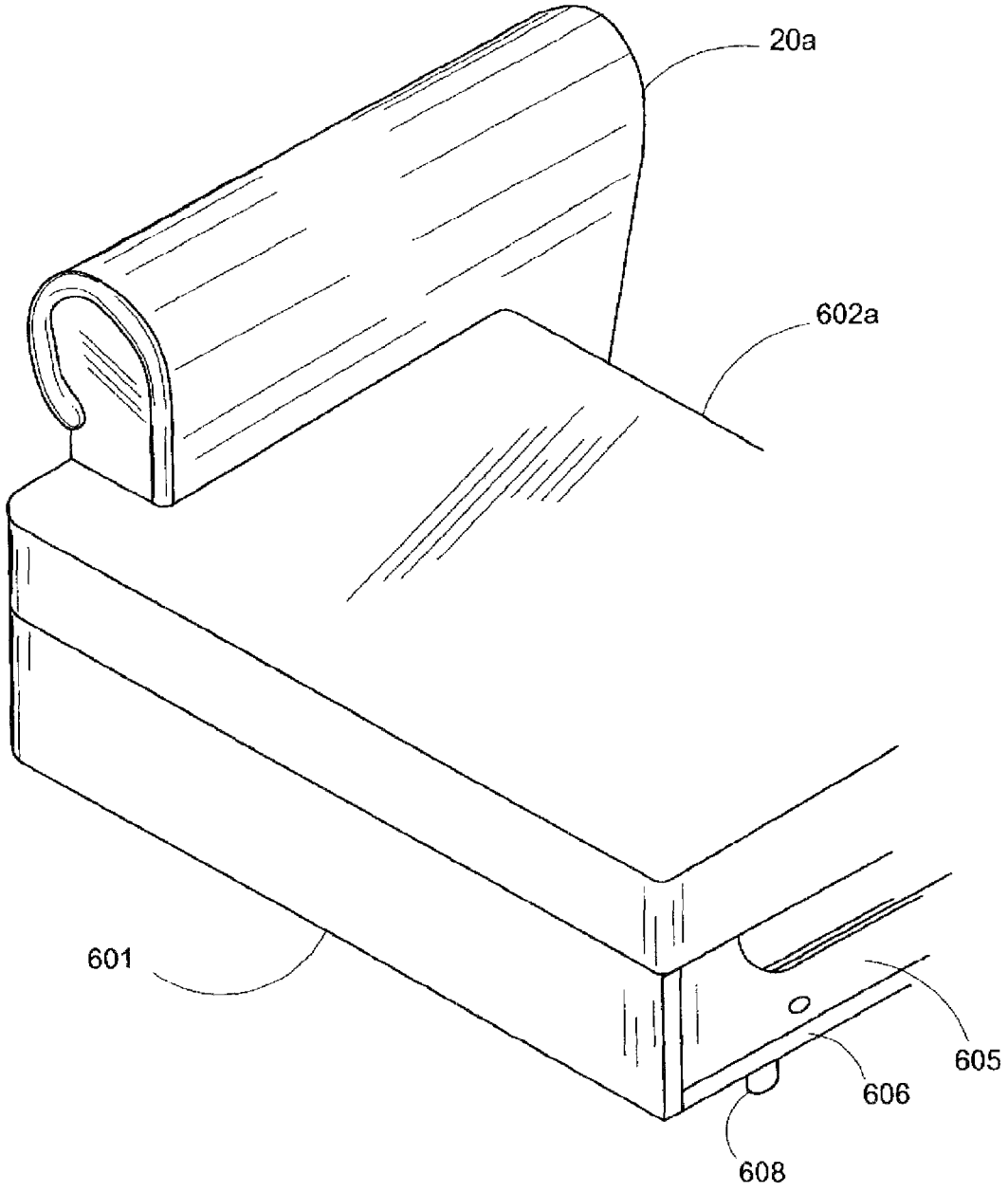
FIG. 37 is a partial view of the present invention in the embodiment of two frame portions.
Figure 38:
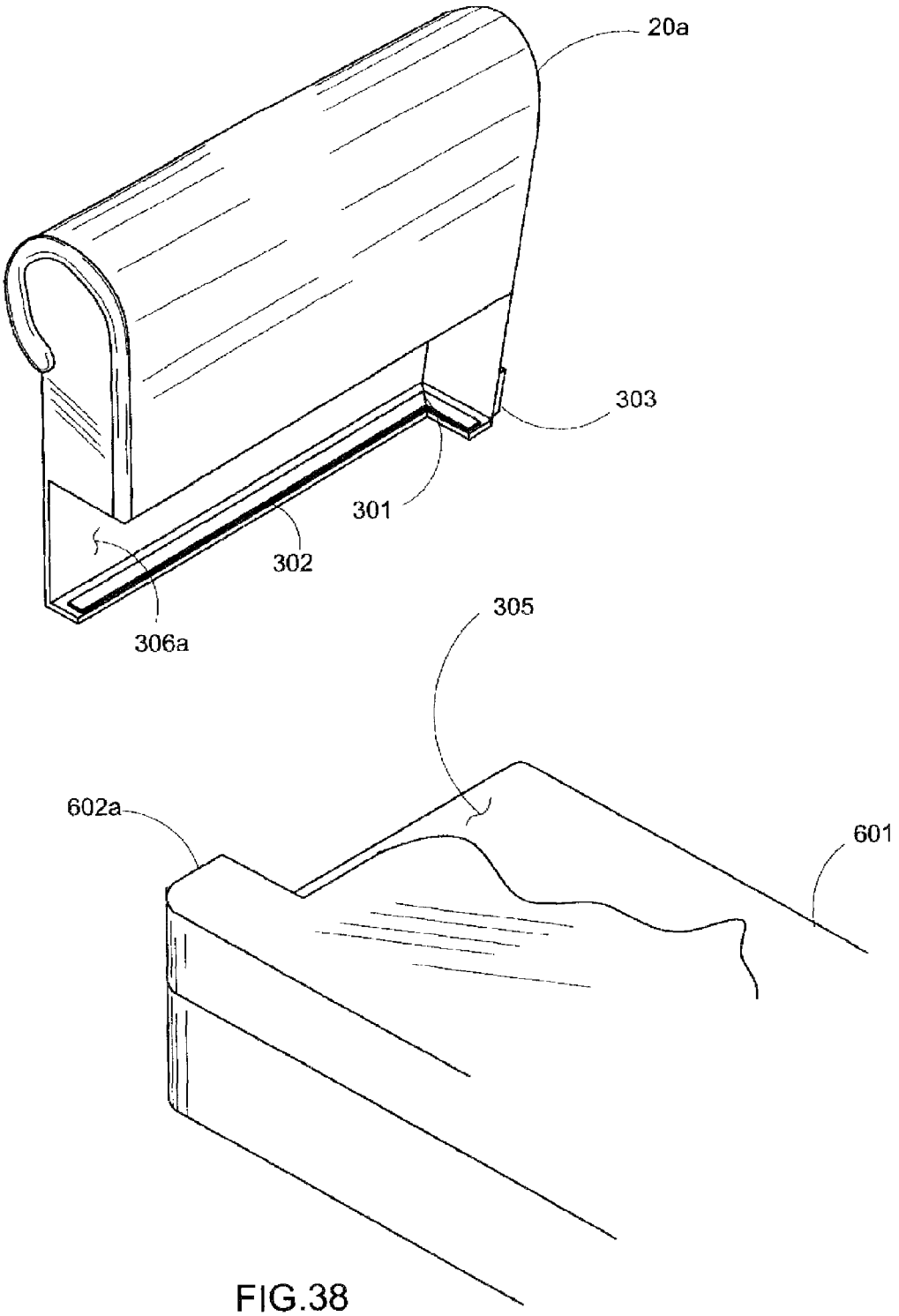
FIG. 38 is a separated view of the arm piece and frame of the present invention.

In another embodiment, as is generally known, RTA furniture typically is shipped without padding on features such as arms and backs. The present invention, in one embodiment, has provided not only RTA furniture, but also done so in a manner such that padding and covering are shipped in a preassembled and preconfigured arrangement. In one embodiment, arm 20A affixes on to frame 40, and arm 20A has an extension portion 306A with a bottom portion 302 and a corner portion 301 that assists for affixation on to frame 40. In one embodiment, as shown in FIG. 35, spring portions 220 are constructed and arranged such that they have sufficient movement in order to facilitate placement of arm portions 20*a* within the cavity of frame 40. As shown in FIGS. 32 and 33 swivel swing gate 307 swivels by virtue of connection into opening 308 of frame 50A. Swivel swing gate has a generally perpendicular position when frame 58 is assembled as a sofa and generally perpendicular orientation is moved to a parallel orientation as shown in FIG. 35. This rotation of either parallel to the general horizontal plane of frame 58 or in the alternative rotation 180 degrees from its downward perpendicular to an upward perpendicular orientation. This upward perpendicular orientation further facilitates placement of arm pieces 20A within frame 40.

As is generally understood, most RTA furniture products do not come with articles such as upholstery and padding affixed thereto. However, the present invention has developed a unique configuration whereby RTA furniture, specifically RTA sofa and RTA chairs, are shipped with padding and upholstery affixed thereto. Affixation of upholstery is in any manner. A preferred embodiment provides the upholstered arm and back portions in which upholstery is affixed using hook and loop fasteners as is known in the art. In general terms, the upholstery has a general configuration corresponding to the shape of an arm or back portion. One edge, preferably the lower edge on which the arm or back portion attaches to the frame, has hook and loop fasteners that both hold the upholstery in place, and provide access to the male-female connectors used to fasten the arm or back portion to the frame.

Figure 28:
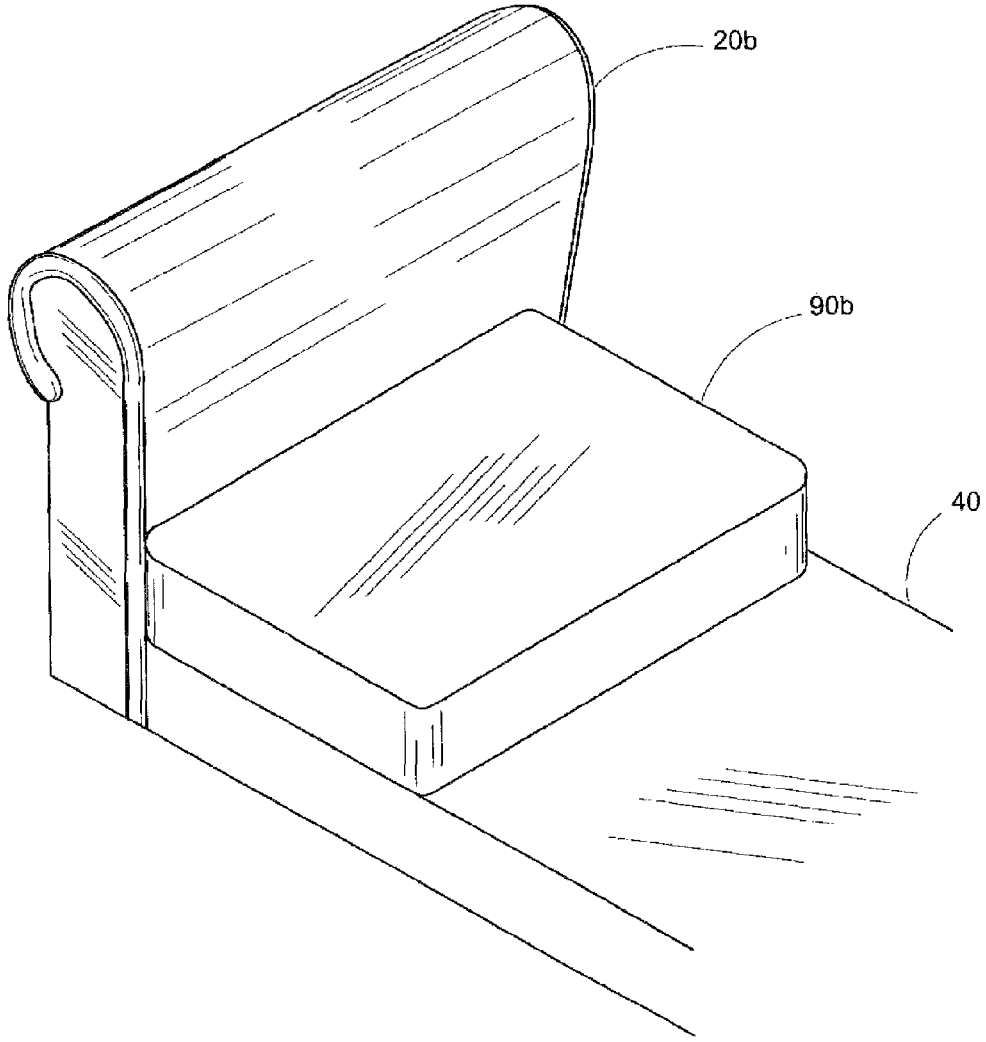
FIG. 28 is a partial connected view of a sofa of the present invention.
Figure 29:
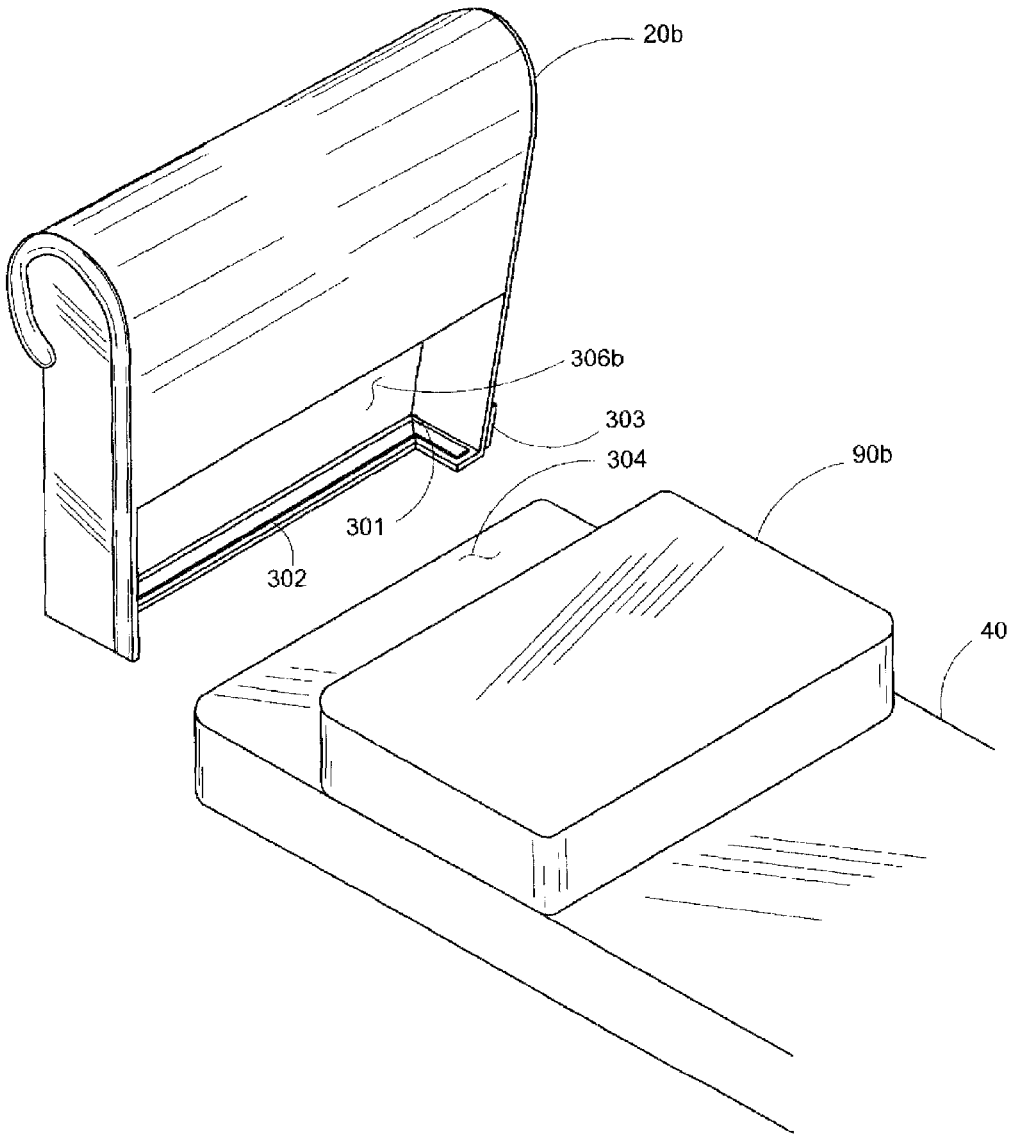
FIG. 29 is a partial separated view showing arm 20B separated from frame 40.
Figure 30:
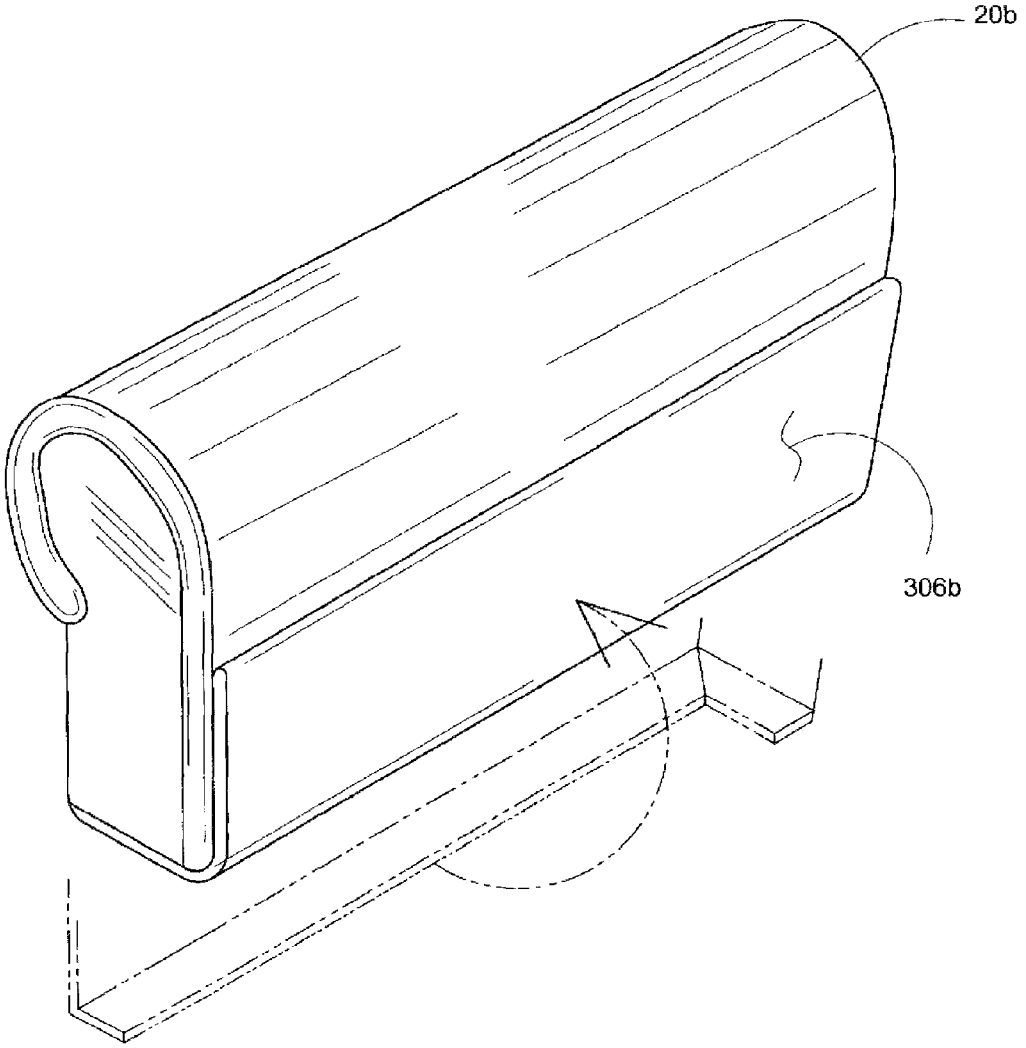
FIG. 30 is a view of arm portion 20B of the present invention showing a portion of upholstery that is folded upward, as indicated by directional arrow, for an unassembled configuration, and is extended downward when the arm is used in an assembled configuration.
Figure 39:
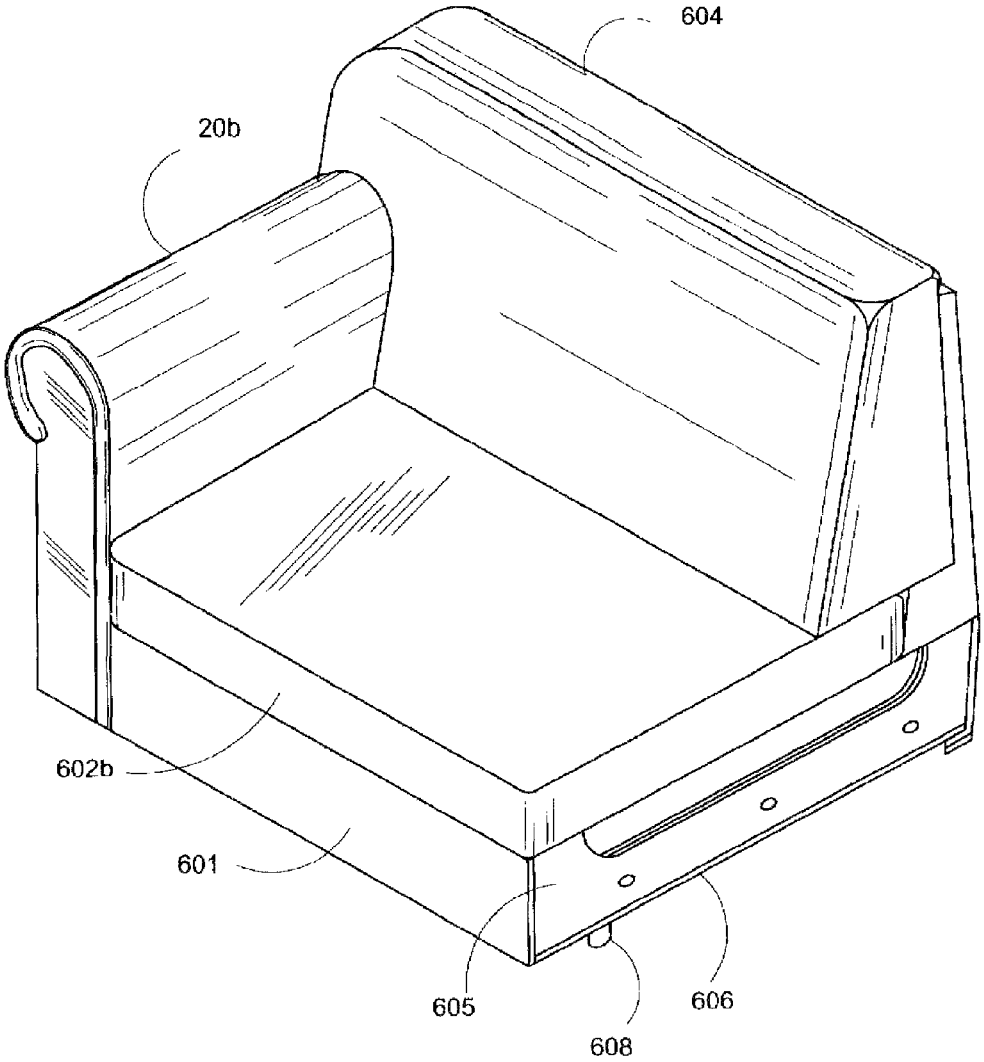
FIG. 39 is a view of a single assembled sofa of the present invention when the invention is formed of two or more frame portions.
Figure 40A:
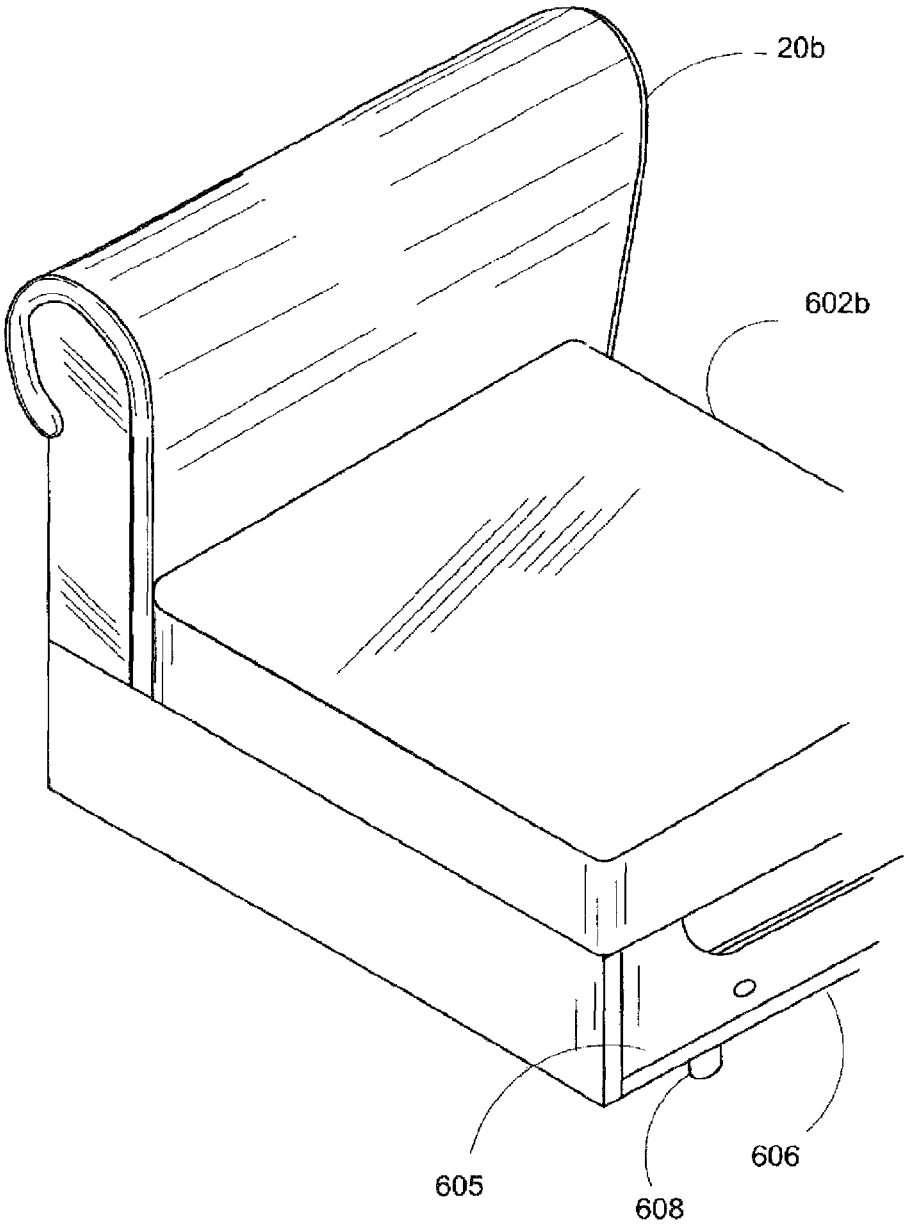
FIG. 40*a* is a view of a single assembled sofa of the present invention when the invention is formed of two or more frame portions showing removal of the arm portion.
Figure 40B:
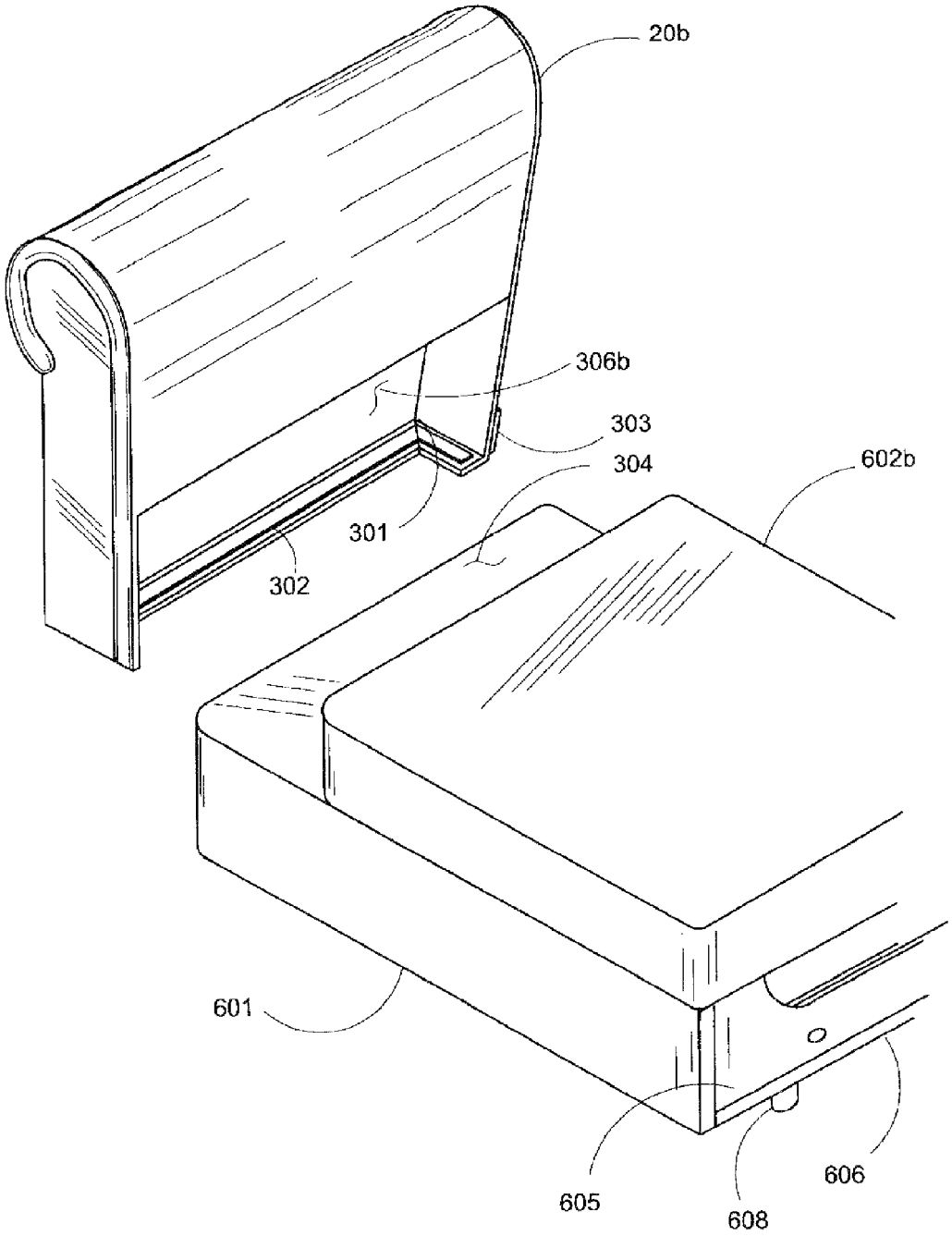
FIG. 40*b* is a view of a single assembled sofa of the present invention when the invention is formed of two or more frame portions showing the side portion configured for connection to a corresponding frame.
Figure 41:
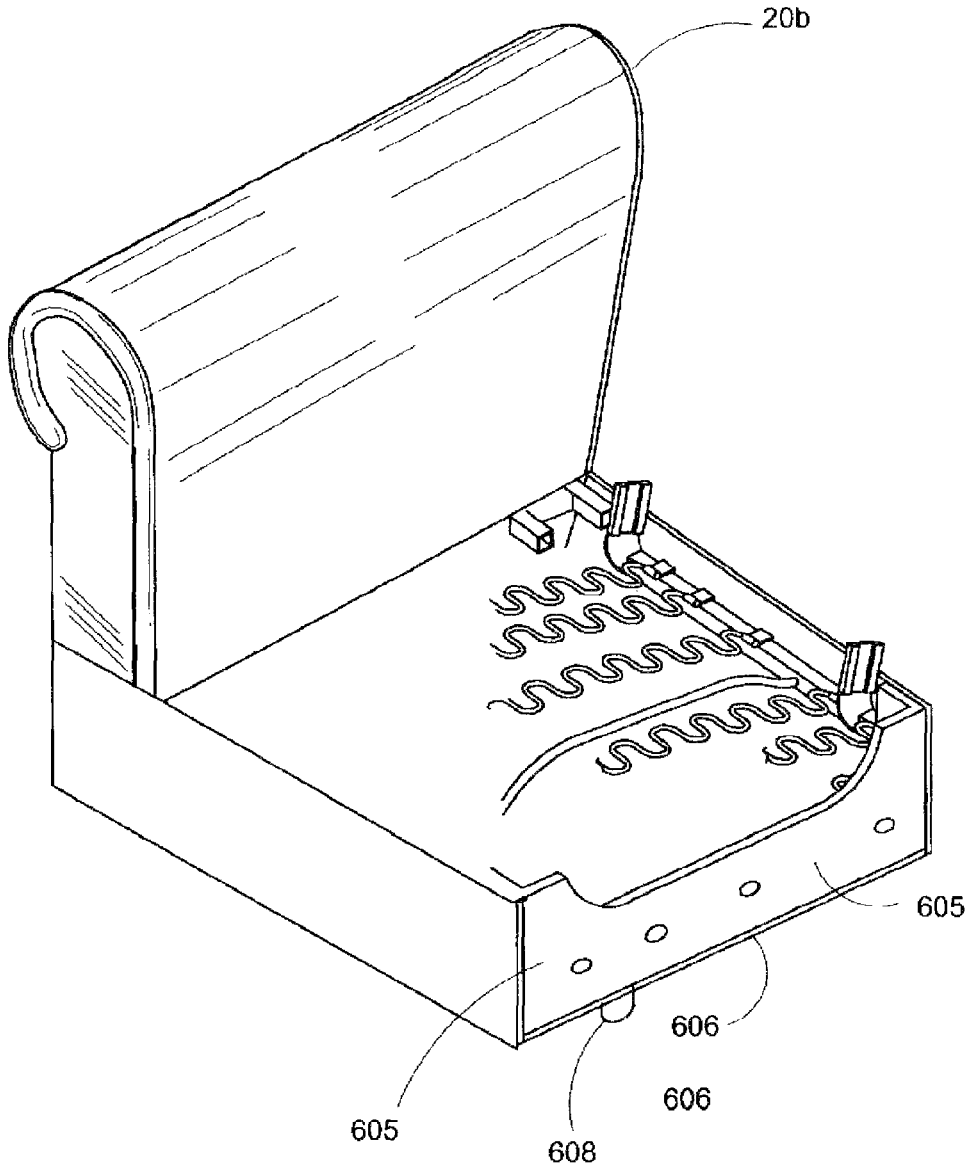
FIG. 41 is a partial cut away view of a single assembled sofa of the present invention when the invention is formed of two or more frame portions showing the side portion configured for connection to a corresponding frame.
Figure 42:
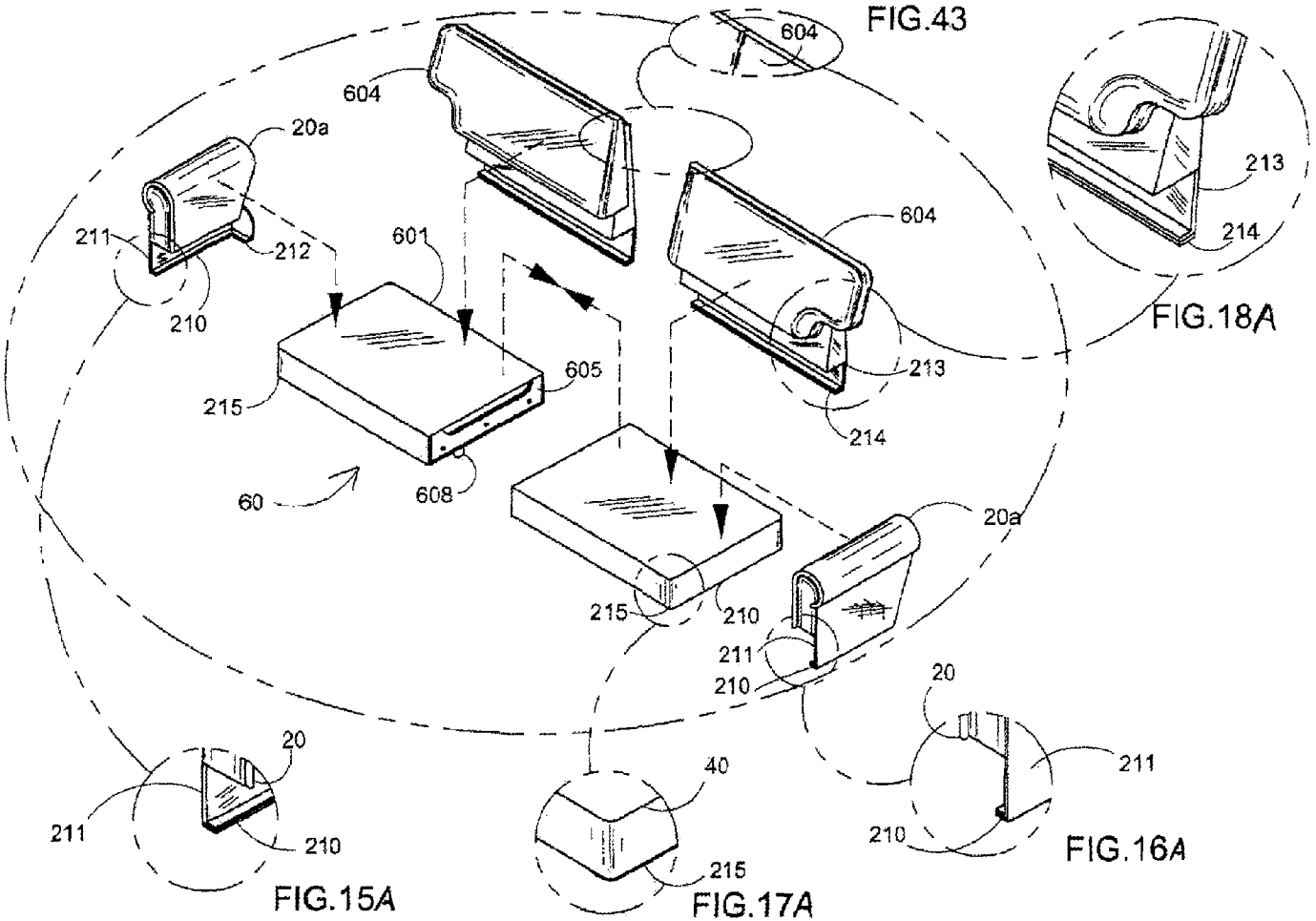
FIG. 42 is a separated view of a sofa in which 2 frames are configured to be ultimately be assembled and attached one to another.

In an embodiment of the present invention, arm pieces are affixed to the top of a frame without the need to have any portion of an arm piece extend downward along side a frame. In this configuration, an arm piece is still able to be securely attached to a frame and provide ease of assembly of an RTA piece of furniture. Additionally, RTA sofa and chairs of the present invention are shipped with a back portion fully upholstered and padded such that affixation of the back portion onto the frame constitutes the complete assembly of the back portion of the RTA furniture. In one embodiment a decorative panel on the front of the arm piece extends downward along the height of the frame, as best seen in FIGS. 28 and 39.

Figure 31:
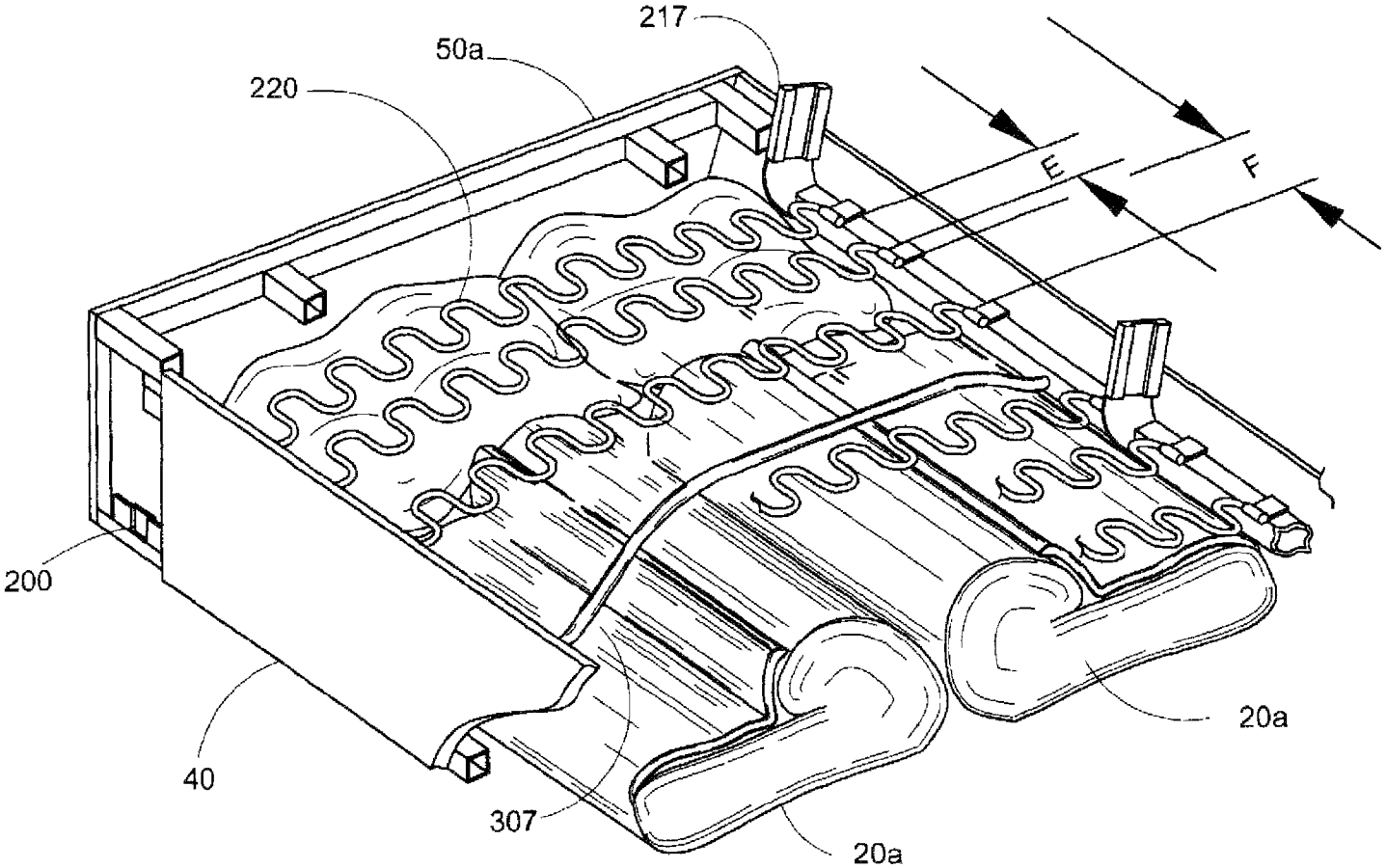
FIG. 31 is a partial perspective view showing placement of cushions within the frame of the present invention and showing that support springs are movable along the horizontal axis on the underside of the frame.

As seen in FIG. 31, support springs 220 can be constructed to move along the horizontal portion of frame 50*a* such that any desired distance, such as distance represented by dimension "E" and "F" in FIG. 31 can be varied as desired. A swivel swing gate 307 in FIG. 31, is swiveled out of the storage cavity to provide maximum storage volume form arm pieces 20*a* stored within.

As is understood and shown in FIGS. 31-33, swivel swing gate 307 is rotatable 360 degrees on a swivel through connection in swivel cavity 308 in frame 50*a*. This allows swing gate 307 to extend downward, perpendicular to the frame in an assembled configuration and swing out of the storage cavity in an unassembled configuration. Completely removing swing gates is generally not desired as the swing gate provides strength and stability and keeps the horizontal portions of the frame from bowing inward towards each other.

Figure 44:
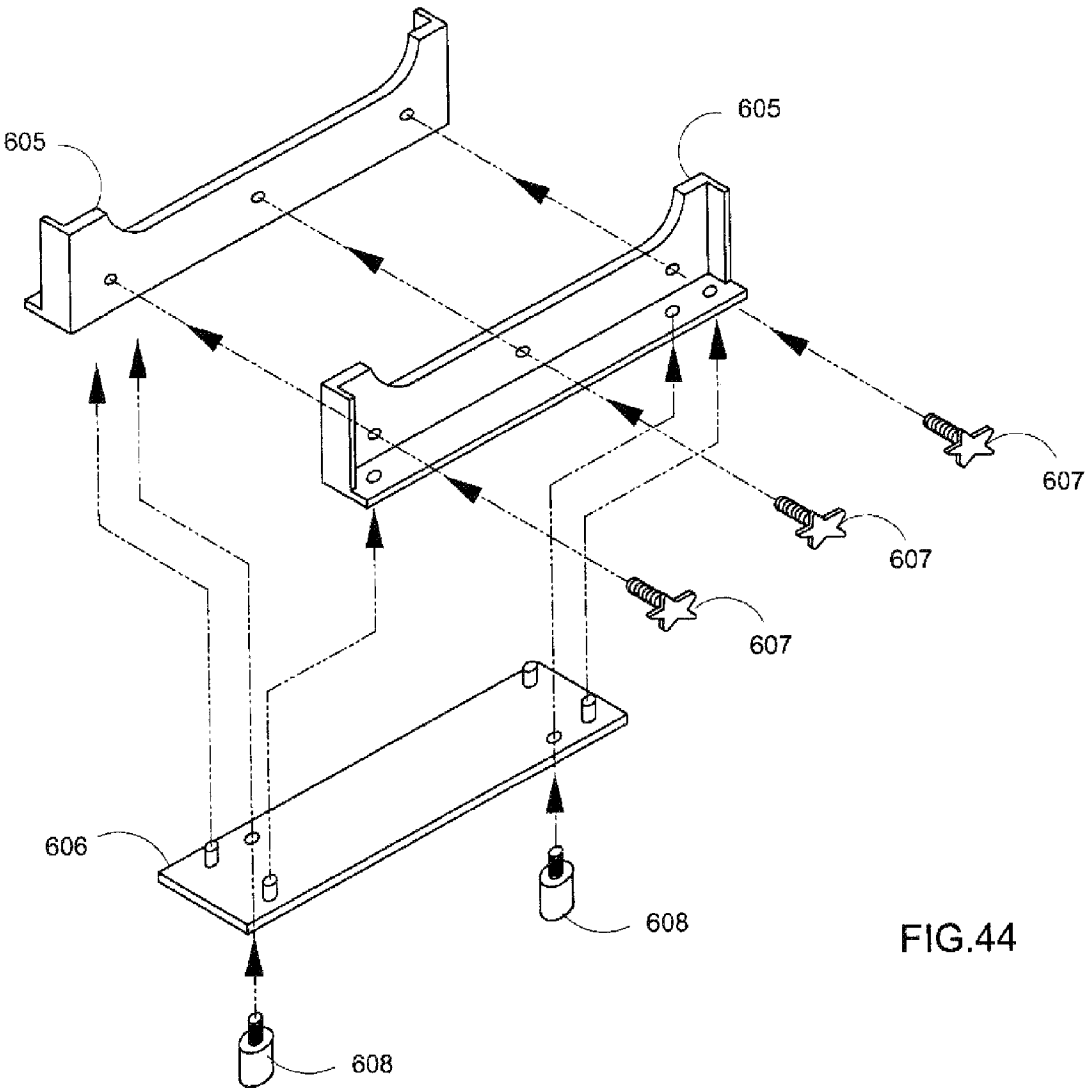
FIG. 44 is a separated view of connectors used to connect either arms to the frame or to connect 2 frames one to another.

In one embodiment, as shown in FIGS. 37-42, more than one frame is provided and the frames are connected when assembled to form a larger article of furniture. Frame 601 has a support 606 and connecting panel 605. There are also legs 608 along and underneath panel 605. As shown in FIG. 44, connection of 2 or more frames at panel 605 and support 606 is through any acceptable connection means. One such RTA connection utilizes male-female connectors such as connecting screws 607.

Figure 45:
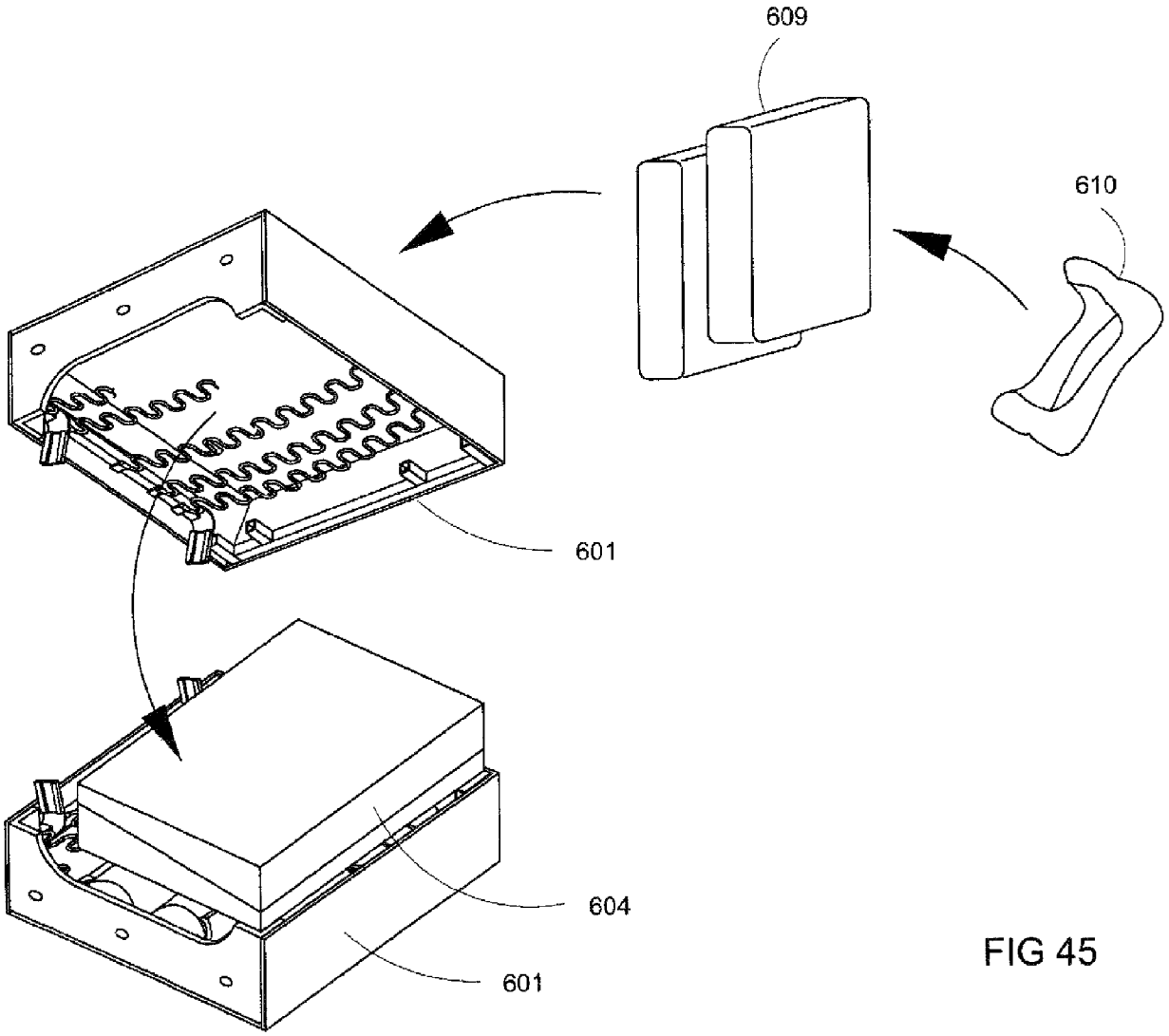
Figure 46:
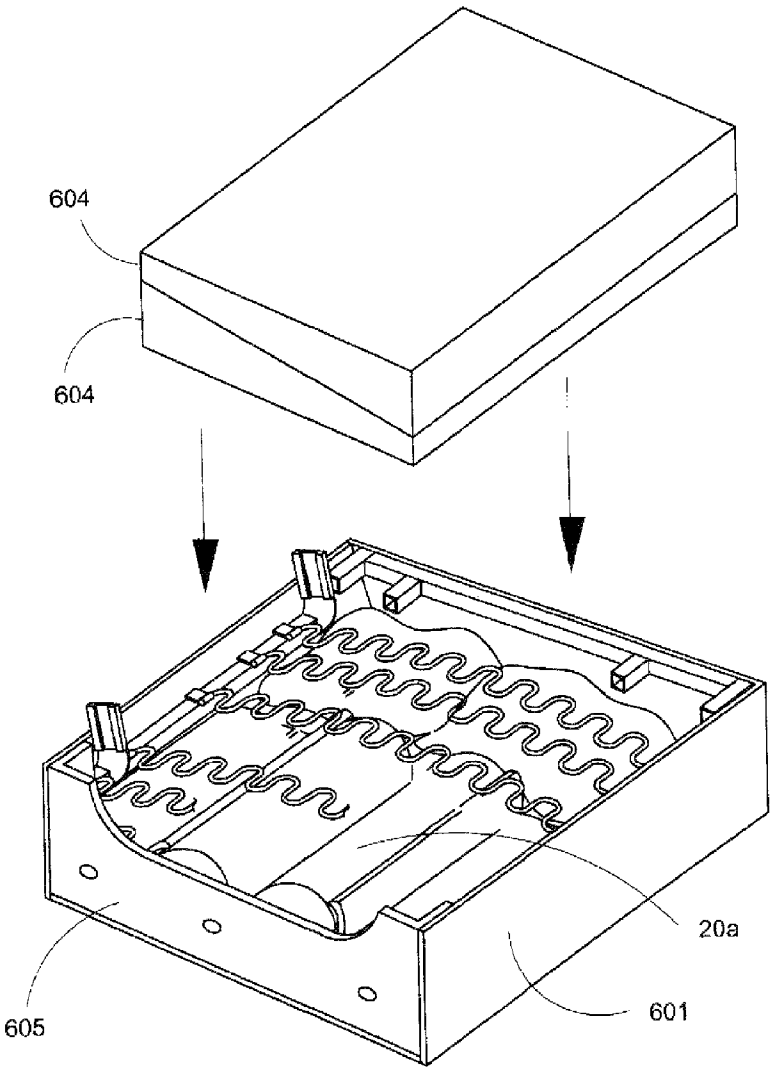
FIG. 46 shows a single frame configuration with arm portions nested within frame cavity.
Figure 47:
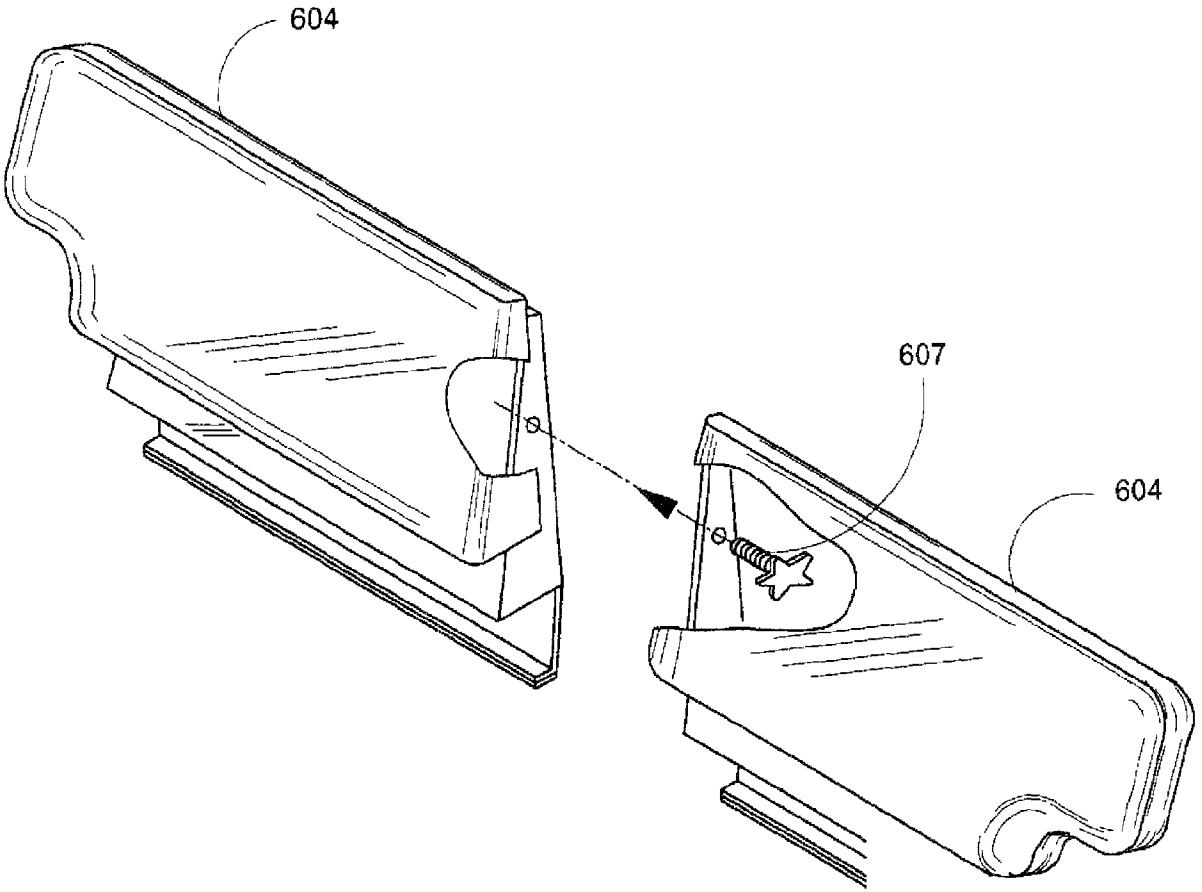
FIG. 47 shows an embodiment having the back portion provide as two pieces that are connected in the assembled configuration.
Figure 48:
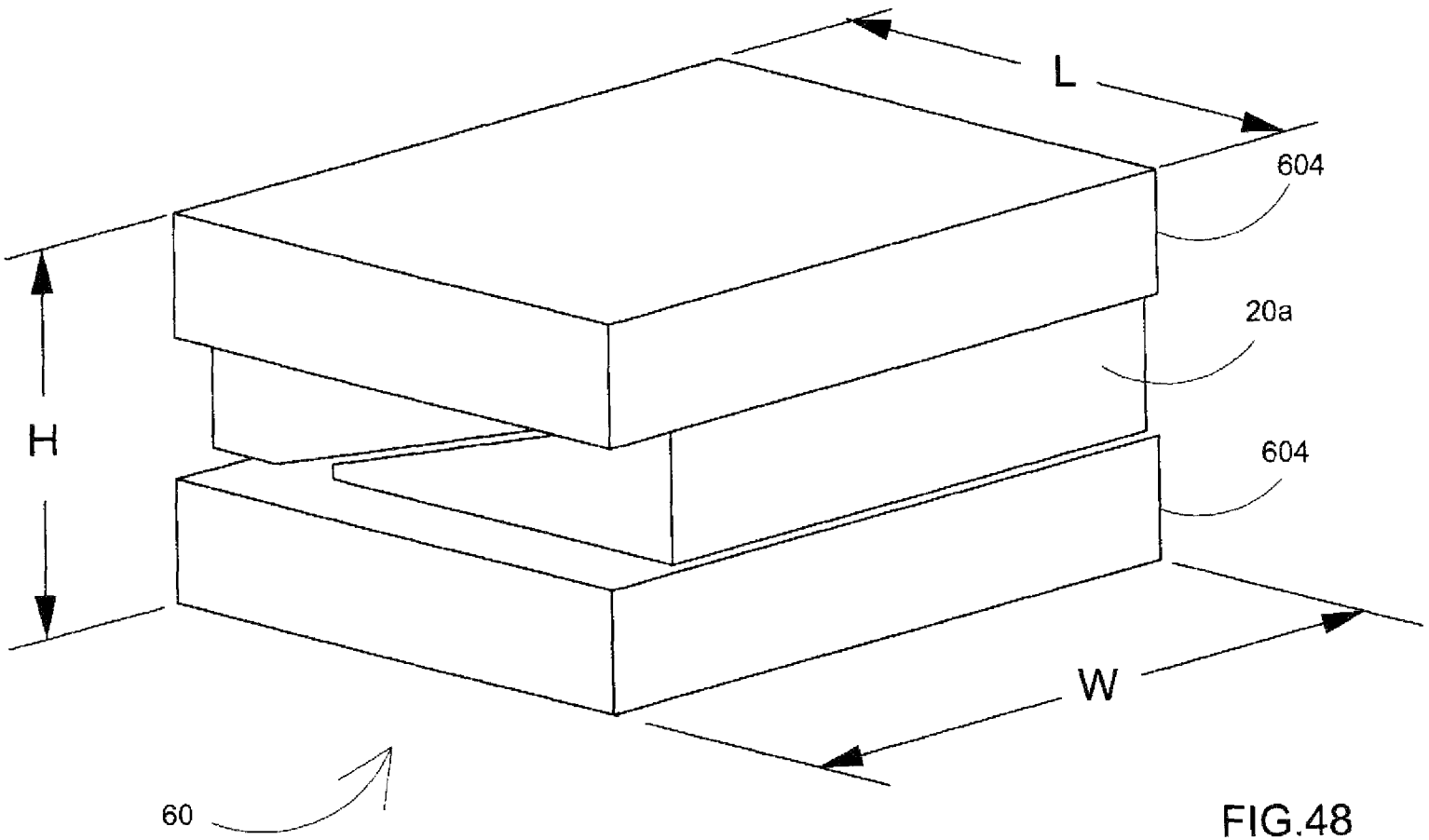
FIG. 48 shows the stacking of 2 frame portions whereby the are storage cavities are on the outside of the stacked unassembled configuration and the arm portions are stored between the stacked frames.

In a disassembled configuration, as shown in FIG. 45, each frame 604 is stacked in opposition such that arm pieces 20*a* are contained there between.

Figure 49:
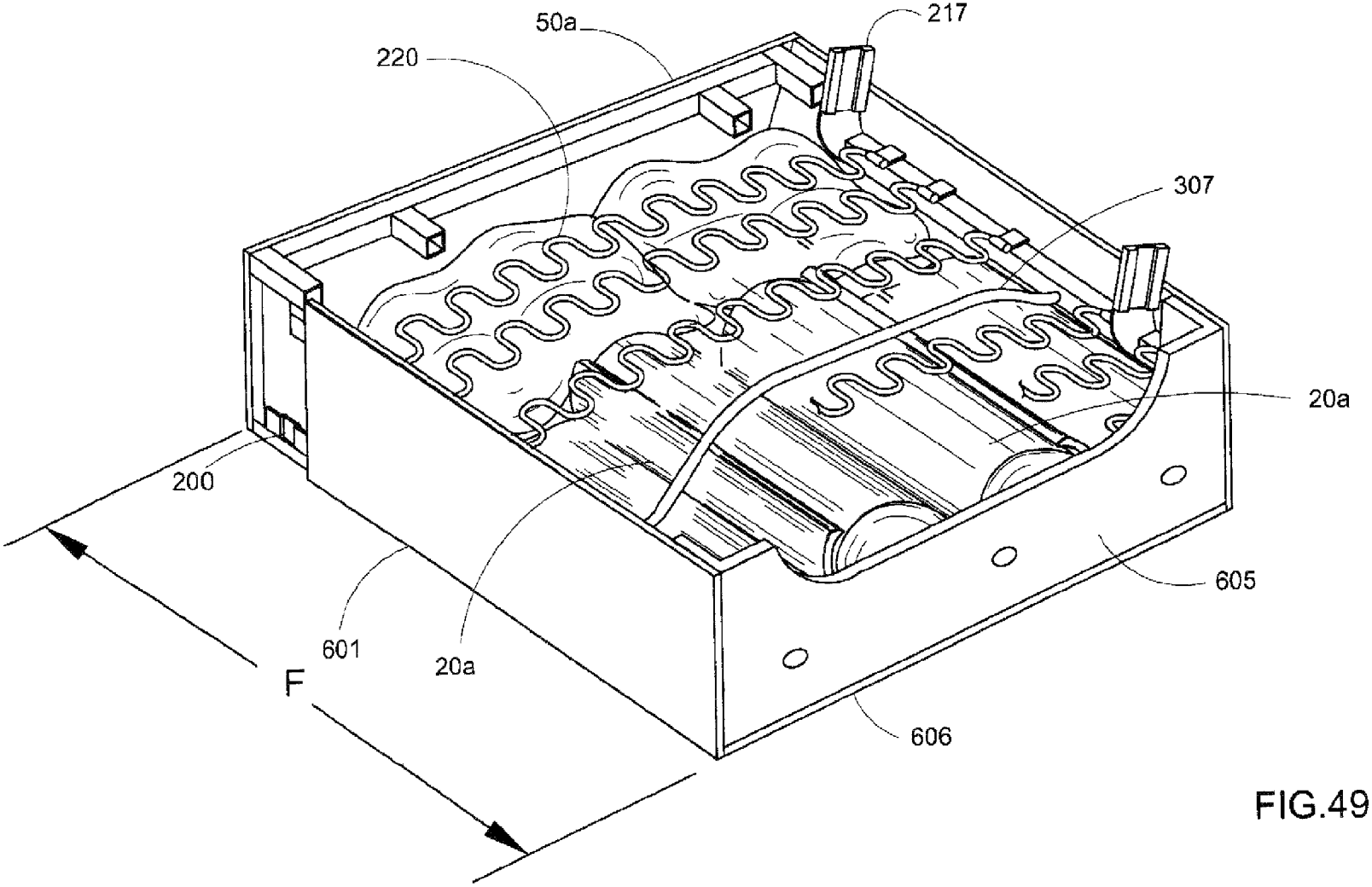
FIG. 49 shows a configuration with arm portions nested within a frame cavity and cushions positioned on top of the unassembled configuration.
Figure 50:
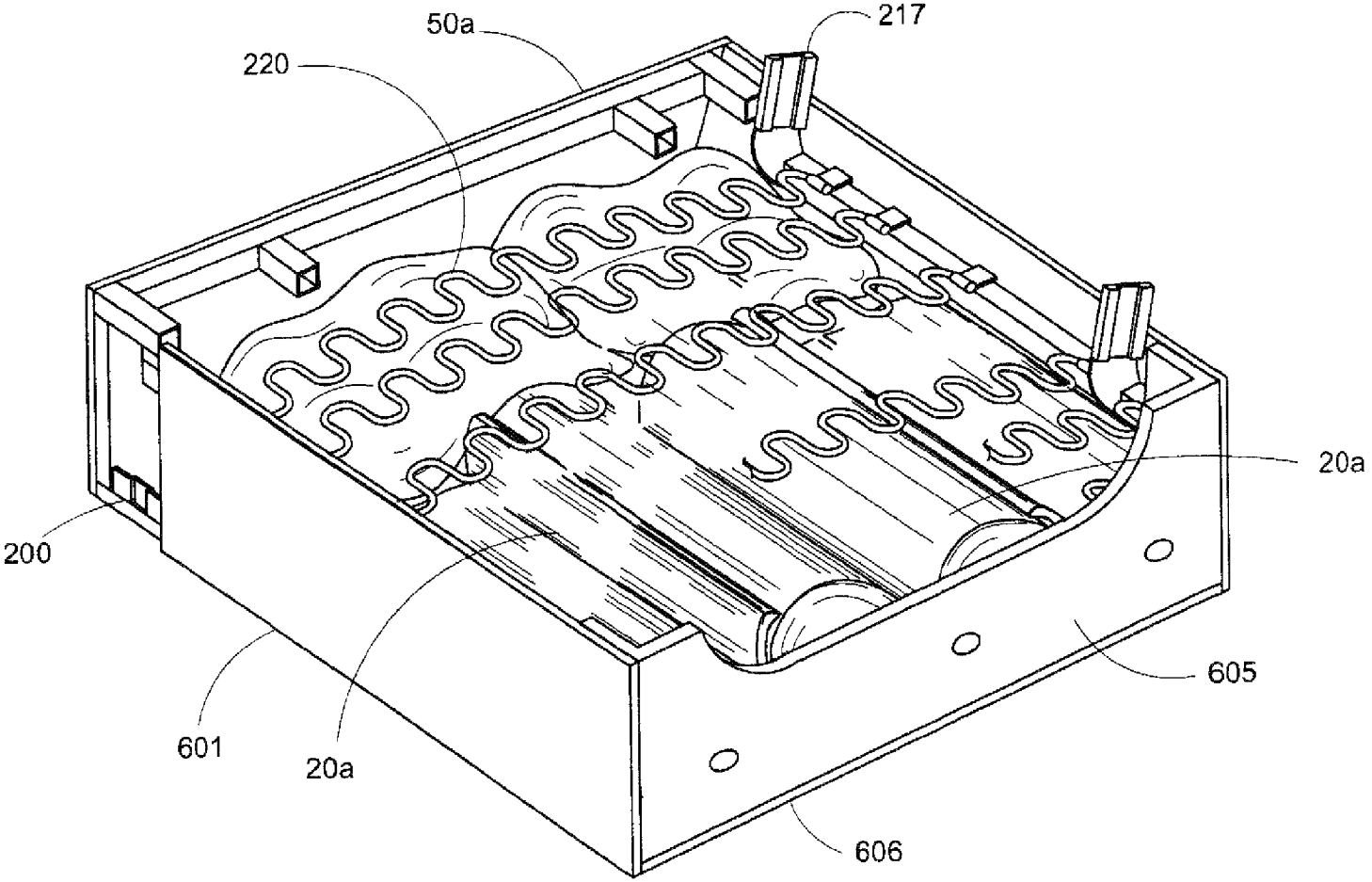
FIG. 50 shows a single unassembled frame with arm portions stored in the storage cavity.

In another embodiment, the back portion can be split into 2 or pieces. This can be in combination with a single frame accommodation a two or three piece back portion or any other configuration that facilitates the assembled and disassembled storage, shipping, and assembly of the present invention. In one embodiment, as shown in FIG. 49, a frame with a length denoted by dimension "F" is used as a single article of furniture and can serve a dual purpose of a single article, or assembled as an attached article to one or more additional frames. In some embodiments, such as FIG. 49, even though a particular frame 601 can be used as a single article without attachment, it still may be required to have swing gate 307 incorporated therein in order to provide support such that springs 220 do not urge horizontal portions of frame 50*a* towards each other and distort the rectangular orientation of either 50*a* 601 or both.

Further, the present invention contemplates one taking a complete assembled sofa, and separating the frames 601 of an assembled sofa into two or more articles of furniture, for example, separation into either a smaller sofa, single chair portions, or combinations thereof.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

The invention claimed is:

1. An upholstered furniture system, comprising:

(a) a first assembled configuration for seating;

(b) a second unassembled configuration for storage and shipping, said upholstered furniture system comprising:

(i) a horizontal seat support frame, said frame having opposing front and rear panels and opposing side panels, said panels arranged fixedly and continuously to define a rectangular storage cavity, said frame further comprising one or more movable support members pivotally connected by first and second ends thereof to said front and rear panels and within said cavity and extending generally perpendicularly therebetween;

(ii) one or more back frame members;

(iii) one or more arm members;

(iv) wherein said one or more back frame members connect to said rear panel, to said one or more arm members, or combinations thereof;

(v) wherein said one or more arm members connect to respective side panels; and further wherein in said second unassembled configuration at least one of said one or more back frame members, one or more cushions to be used in said system, said one or more arm members, or combinations thereof, are positioned in said cavity.

2. The furniture system of claim 1, wherein said unassembled configuration is substantially rectangular.

3. The furniture system of claim 1, wherein said horizontal seat support frame comprises a back longitudinal frame member having a vertical angular offset.

4. The furniture system of claim 1, wherein each arm member is constructed and arranged providing each arm member, in said assembled configuration, has a base portion that affixes to an uppermost portion of said horizontal seat support frame.

5. The furniture system of claim 1, wherein each arm member has a base portion positioned directly upon only an upper surface of said horizontal seat support frame.

6. The furniture system of claim 1, wherein each arm member, in said unassembled configuration, is provided with padding, upholstery, and unobstructed access to male-female connectors.

7. A method of shipping Ready to Assemble (RTA) furniture, comprising the steps of:

(a) providing RTA components of furniture comprising:

(i) a horizontal seat support frame, said frame having opposing front and rear panels and opposing side panels, said panels arranged fixedly and continuously to define a rectangular storage cavity, said frame further comprising one or more movable support members extending generally perpendicularly between said front and rear panels and within said cavity;

(ii) one or more back frame members;

(iii) one or more arm members;

(iv) wherein said one or more back frame members connect to said rear panel, to said one or more arm members, or to combinations thereof;

(v) wherein said one or more arm members connect to respective opposing side panels;

(b) arranging said RTA components in an unassembled configuration, wherein at least one of said back frame members, one or more cushions to be used with said furniture, one or more of said arm members, or combinations thereof, are positioned in the rectangular storage cavity; and (c) packaging the unassembled rectangular configuration of the RTA components into a conventional shipping container.

8. The method of claim 7, wherein said one or more cushions are vacuum packaged to reduce volume of space needed for storage and shipping.

* * * * *